US006394866B1

(12) United States Patent
Brown

(10) Patent No.: US 6,394,866 B1
(45) Date of Patent: May 28, 2002

(54) 1-STEP SAFETY BELT INFLATABLE INTO A LIFE VEST

(76) Inventor: Dennis Brown, 1358 Hooper Ave. Suite 240, Toms River, NJ (US) 08753

( * ) Notice: Subject to any disclaimer, the term of this patent is extended or adjusted under 35 U.S.C. 154(b) by 0 days.

(21) Appl. No.: 09/925,132

(22) Filed: Aug. 10, 2001

(51) Int. Cl.[7] ..... B63C 9/08
(52) U.S. Cl. ..... 441/108; 113/118
(58) Field of Search ..... 441/94, 108, 111, 441/113, 106, 114, 115, 116, 117, 119, 120, 122, 123, 121, 118

(56) References Cited

U.S. PATENT DOCUMENTS 1,251,394 A * 12/1917 Lyon ..... 441/111
4,626,221 A * 12/1986 Rocco ..... 441/108
5,022,879 A * 6/1991 DiForte ..... 441/108
5,179,569 A * 1/1993 Sawyer ..... 340/600
5,180,321 A * 1/1993 Brown ..... 441/108
5,368,512 A * 11/1994 Brown ..... 441/108
5,393,254 A * 2/1995 Ducheshe ..... 441/108
5,702,279 A * 12/1997 Brown ..... 441/108
5,911,612 A * 6/1999 Steger ..... 441/116
6,004,177 A * 12/1999 Biesecker et al. ..... 441/106
6,036,562 A * 3/2000 Brown ..... 441/108

* cited by examiner

*Primary Examiner*—Stephen Avila
(74) *Attorney, Agent, or Firm*—Charles I. Brodsky

(57) ABSTRACT

A flotation device of the invention—of cell shape, substantially flat and of little bulk when deflated—is able to be filled with a compressed gas from a cartridge coupled with it so as to unfold and expand outwardly under action of the compressed gas which fills it. A belt of a jacket with an adjustable strap overlies the flotation device about the waist of a wearer and is coupled with it by a drawstrap. When the flotation device is filled with the compressed gas, its length increases to that of a life vest which can be placed around the head and about the neck when being donned. Pulling down the end of the drawstrap snugly secures the flotation device to the adjustable strap which continues to be worn about the waist. An elongated tube allows the wearer to orally inflate the vest should the compressed gas tend to leak over time, in keeping the head out of the water. The drawstrap is fixed to the waist strap at its inside center so as to bring end sections of the inflated flotation device towards one another when the drawstrap is being pulled, in tightening the life vest about the neck.

11 Claims, 25 Drawing Sheets

1-STEP SAFETY BELT INFLATABLE INTO A LIFE VEST

FIELD OF THE INVENTION

This invention relates to personal flotation devices and, more particularly, to a safety belt which can be inflated for use as a life vest in both a fresh-water and salt-water environment.

BACKGROUND OF THE INVENTION

As is well known and understood, personal flotation devices (PFDs) are available in a variety of shapes, colors and materials. Typically required for recreation boat use, how many, and what type PFDs are required depends on the number of people on board, the size of the boat, and the kind of boating being done.

As is also known, there presently exist two basic types of PFDs—the inherently buoyant vest of a primarily foam composition, and the fully inflatable type activated by a pulling action which punctures a compressed gas cartridge.

While such devices are typically employed by those on boats—fishing, canoeing and kayaking—a very large market exists for those who do not go near the water at all, either because they cannot swim or are afraid to go into the water, but who could benefit through the use of some type of personal flotation device.

My U.S. Pat. No. 5,180,321, issued Jan. 19, 1993 and entitled "Swimmer's Safety Belt" describes a substantially hollow belt, worn about the waist, and able to assume the shape of a life preserver in use, while allowing the wearer to swim to safety after entering the water, using whatever swim strokes may be convenient. As is there set forth, a compressed gas cartridge is employed to fill the belt in allowing the life preserver so formed to ride up to the wearer's arm level.

My U.S. Pat. No. 5,368,512, issued Nov. 29, 1994 and entitled "Inflatable Swimmer's Safety Belt", on the other hand, went further in describing the use of a pair of belts, tethered together, to restrict the life preserver arrangement to rise up to the wearer's arm level, to hold the wearer vertically in the water—thereby obviating the possibility of the life preserver moving;over the shoulders and head of the wearer and somehow possibly coming free. With this feature, a life preserver tube was formed of the first belt, tied to the second belt at a length which prevented the tube from slipping over the shoulders and head, even while still allowing the wearer to be able to swim about.

While the safety belts described in these two patents performed quite well from a safety standpoint, the belt described in my further U.S. Pat. No. 5,702,279, issued Dec. 30, 1997 and entitled "Inflatable Swimmer's Safety Belt, Life Preserver/Life Vest" went even further. The safety belt there described could be arranged either as a life preserver, to allow the wearer to continue to be able to swim about, or could be further converted to a life vest, in holding unconscious wearers face-up in the water—or, for use by non-swimmers or children, and for those who could only swim short distances without tiring, while trying to reach shore or to reach a rescue boat. A pair of belts, tethered together, were again used, with the first—substantially hollow and worn about the waist—being able to be filled with the compressed gas in unfolding and expanding outwardly, and with the second underlying the first on the waist. When the first belt was filled with compressed gas, its length increased to form a horizontal tube riding under the arm pits, in holding the wearer vertically as a life preserver, while allowing the wearer to be able to swim about. Couplings were provided on the first belt for maintaining circular configuration, all the while permitting the tube to be slid over the arms to the shoulders and neck area in continuing to hold the wearer vertically, but this time, as a life vest, keeping the head of the wearer out of the water. As with my U.S. Pat. No. 5,368,512, the tether of this construction prevented the tube from coming loose from the second, or waist, belt and floating away.

My U.S. Pat. No. 6,036,562, issued Mar. 14, 2000 and entitled "2-Step Swimmer's Safety Belt Inflatabale Into A Life Preserver And A Life Vest" then took these inventions one more step. In particular, it utilized the first, inflatable belt to again inflate to a life preserver upon actuating the compressed gas cartridge, which was then to be fitted over the arms to the shoulders and neck area in forming a life vest when being donned. A "drawstrap" was used, instead of the previously employed tether, to keep the life vest snugly attached and secured to the second jacket belt. As there set forth, besides simplifying the manner by which the safety belt was put on and adjusted, the arrangement resulted in a streamlining of the construction, to the extent that the safety belt, before inflating, could readily be worn either in the front or back, automatically and immediately inflating to the life preserver position once the compressed gas was released, without the wearer having to do anything else.

As described in this, my most recently issued patent, an exceedingly comfortable, lightweight, smooth, personal flotation device-resulted, which could be worn simply as a belt, in front or in back, whether in or out of the water, and for hours on end. With an appearance not very much different from that of an ordinary belt securing one's clothing at the waist, a lanyard could be further included, to be simply pulled in puncturing the compressed gas cartridge. When so done, the safety belt automatically inflated the tube as a life preserver, and one whose positioning about the arms, shoulders, head and neck as a life vest could be tightened by simple adjustment of the drawstrap which coupled the tube to the waist belt for maximum stability.

SUMMARY OF THE INVENTION

As will become clear from the following description, the safety belt of this invention again inflates upon actuating the compressed gas cartridge but is one which automatically inflates to a life vest directly in front of the user, without any need to convert first from a life preserver position, as in my U.S. Pat. Nos. 5,702,279 and 6,036,562 arrangements. Instead of a pair of belts being employed, a folded, inflatable cell will be seen to be packed inside the waist belt as a jacket to inflate as the life vest, and which is then pulled over the head and about the neck in being donned. A different "drawstrap" connection is likewise employed to keep everything snugly attached and secured and positioned, leading to a streamlining of the construction in which the safety belt, before inflating, could be worn in the front in a manner far less obtrusive then with a fanny pack which conventionally incorporates a pouch to contain an inflatable vest. Additionally, simpler repacking of the belt for further use will be seen to result, different from the overlapping Z-fold repacking employed in my U.S. Pat. No. 5,702,279 and U.S. Pat. No. 6,036,562 designs.

As such, it will be appreciated that the 2-step belt of my U.S. Pat. Nos. 5,702,279 and 6,036,562 designs is particularly useful for swimmers who are caught in riptides, or get a cramp while swimming, and need just a quick-rescue flotation ring to get them back to shore. With the present invention on the other hand, it will be seen that it is designed more for boaters, who may be stranded in the water for some time before rescue, or become incapacitated, and therefore need a life vest, rather than a life preserver that will allow them to swim about.

Furthermore, whereas the conventional fannypack with its pouch-containing inflatable vest inflates directly in front of a user's chest region, it does so in a very rigid manner which allows very little room for vest movement, primarily because of its securement to the waist belt by a very short drawstrap. Such restraint of movement has been noted to create a frequent problem in that when the vest improperly deploys in a reverse or twisted manner, as it occasionally does, the user has been noted to have extreme difficulty in correcting the problem. Also, with the fannypack, with its short drawstrap being concealed beneath the inflated vest, few users have been noted to actually adjust it tight in practice, oftentimes leading to the vest accidentally slipping over the user's head in such instances as when the user, after deploying the vest, is jumping from a boat. With the safety belt of the present invention, on the other hand, a much freer life vest configuration is presented upon inflation, with a much longer, looser drawstrap to allow clear visibility to the user and a greater latitude in both manipulating the inflated vest and donning it. As will be appreciated then, this aspect of the invention eliminates these problems.

Additionally, where the fannypack vest deploys incorrectly, e.g., in a reverse manner, such reversal presents the further problem of placing the oral inflator tube at the back of the vest, instead of at the front, making it exceedingly difficult for a user to manually fill the vest with wearer's breath as the vest loses its compressed gas while the user is in the water over any extended time. With the construction of the present invention, to be described, the oral inflator tube can be reached whether or not the user reverses the inflated life vest when placing it over the head and about the neck.

Besides the construction of the present invention allowing for a streamlining of the resultant belt so that it fits so flatly against the abdominal region that it has very little, if any, discernible profile—as contradistinct from that attendant with the conventional fannypack—the construction goes further in allowing for a more correct packing than with the fannypack version. In particular, although the fannypack vest might appear to be correctly packed, at times it has been noted not to inflate when later actuated—and, because the user has inadvertently packed some of the folded vest material underneath the lanyard arm so that when the lanyard is pulled, that material blocks the puncturing of the compressed gas cartridge; this malfunction being due in part to the location of the gas cartridge actuator inside the fannypack pouch instead of on the outside. With the design of the 1-step belt of this invention, on the other hand, the gas cartridge actuator is located on the outside of the belt in such a manner that there is no folded vest material to obstruct the proper operation of the gas cylinder actuator when the lanyard is pulled, and the self-adhering hook and loop Velcro strips located at the bottom of the construction instead of at the top, pulling-down on the lanyard consistently pulls open the Velcro strips of the waist jacket belt, thereby allowing the folded life vest to freely emerge, deploy and inflate.

Thus, and as will be more specifically described below, the safety belt of this present invention goes that much further from my earlier designs in its utilization of a waist jacket belt preferably containing a folded rectangular, oblong, elongated or oval shaped inflatable cell which, upon actuating the compressed gas cartridge, inflates into a life vest which is then donned by pulling over the head and about the neck. The adjustment of the drawstrap will be appreciated to keep the life vest snugly attached and secured to the jacket belt by a box stitch; for example, to remain buckled around the waist in preventing the inflated life vest from drifting away or otherwise becoming lost to the wearer when in the water.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
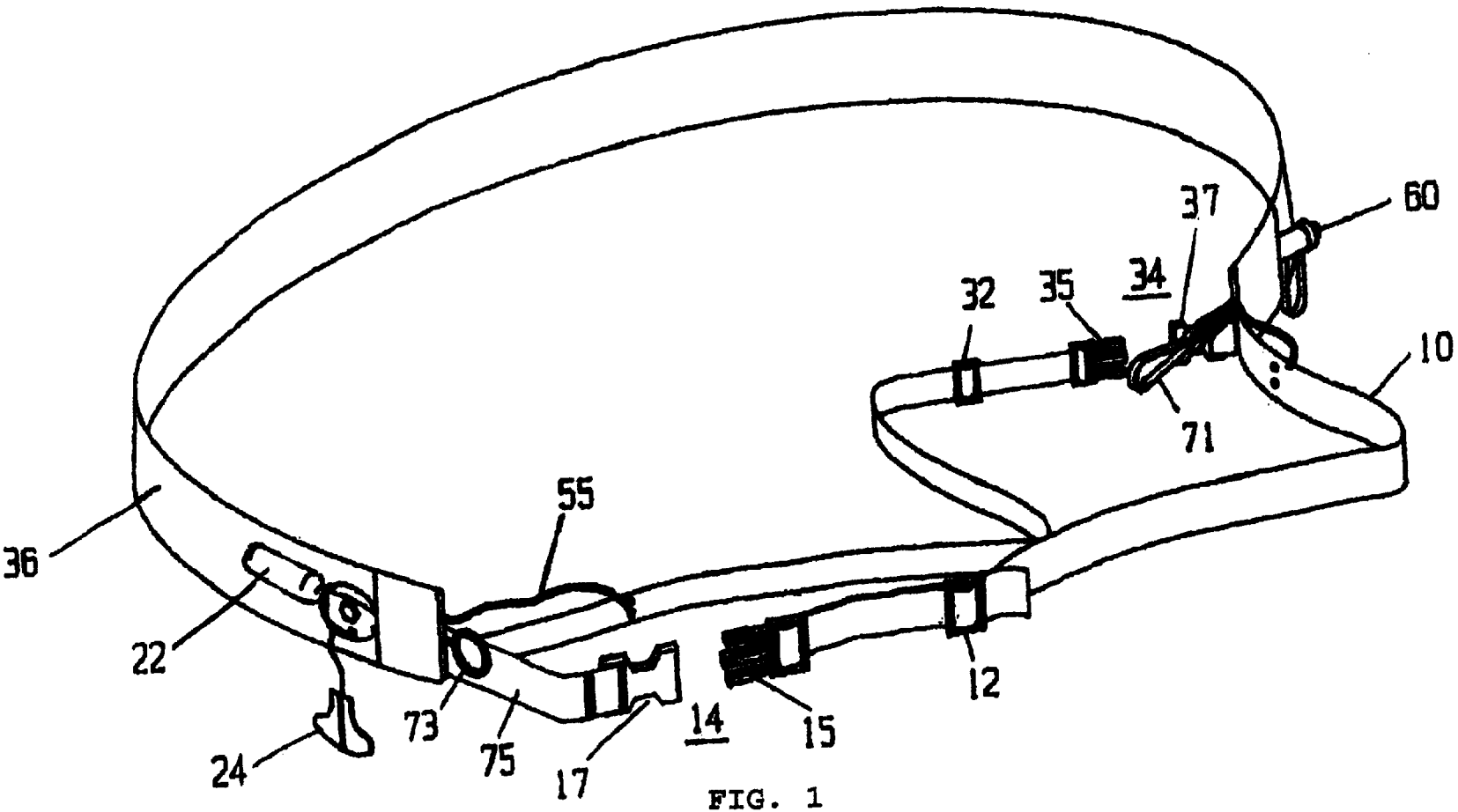
FIG. 1 PRIOR ART
FIGS. 1–4 are perspective views helpful in an understanding of the inflatable swimmer's safety belt of my U.S. Pat. No. 5,702,279, which serves as prior art to the present invention.

Referring to FIGS. 1–4, the prior art inflatable swimmer's safety belt, life preserver/life vest of my U.S. Pat. No. 5,702,279 incorporates a first, substantially hollow belt 10;, constructed of a rugged nylon, polyurethane-coated material or similar leak-proof composition, and adjustable in length in any appropriate manner by clip 12, and closable by a releasable lock arrangement, for example, 14. The arrangement of the clip 12 and the releasable lock 14 is such as to enable the size of the belt 10 to be adjusted, i.e., to fit the length of the belt 10 so as to encircle the waist of a wearer. As will be particularly seen from FIG. 2, the belt 10 is provided with foldable, overlapping sections 16 which, when eventually deployed, are pinched-off into separate interconnecting rectangular-like sections **18*a*-18*e* as an illustration (FIG. 3), at predetermined intervals 20 along its length. The releasable lock 14 may be formed of a clasp 15 and a snap-buckle 17**, each of conventional design.

Also shown in FIGS. 1–4, as by reference notation 22, is a compressed gas cartridge of a well known type, puncturable by a pin (not shown) movable with respect to the cartridge 22. As will be appreciated, the cartridge 22 is further coupled with the belt 10 so as to discharge its compressed gas when punctured, and so as to fill the belt 10—and its sections **18*a*-18*e*—in the nature of a horizontal tube, similar to a life preserver. A compressed gas cartridge of this type, puncturable by a pin actuator and with a cartridge which can be removably coupled and replaced after use, is shown and described in U.S. Pat. No. 3,754,731. A carbon dioxide compressed gas cartridge 22** may be employed of 25 gram capacity (or even 35 grams), although a smaller cartridge of 16 grams could be utilized instead, to provide the degree of buoyancy required, depending upon whether this type of personal flotation device is to be used in rough, open water on the one hand, or in calm, inland water, on the other hand, as an example.

As with the inflatable swimmer's safety belt of my U.S. Pat. No. 5,368,512, any type of device may be employed to actuate the pin in puncturing the cartridge 22 to discharge its compressed gas. In FIGS. 1–4, as an illustration, a lanyard 24 may be "jerked" to cause the pin movement to puncture the cartridge 22, as described in U.S. Pat. No. 3,754,731.

The belt 10 may then be worn by a swimmer, or simply as a safety belt by an occupant of a water craft, and when adjusted for comfort and size by the clip 12 (or by any other type of clip and lock arrangement 14), closes to fit the waist of the wearer, with the compressed gas cartridge 22 then sealed. If the swimmer wearing such belt then finds himself or herself in difficulty in the water—or if the occupant of the water craft, boat, canoe, or kayak wearing such belt inadvertently falls out into the water—the lanyard 24 can be "jerked" accordingly, so as to cause the puncture of the cartridge 22 and the automatic filling of the hollow belt 10 and its sections 18*a*-18*e* as a life preserver tube. In this manner, the belt 10 and its component parts comprise an inflatable belt which inflates into a life preserver when the compressed gas cartridge 22 is activated.

Figure 2:
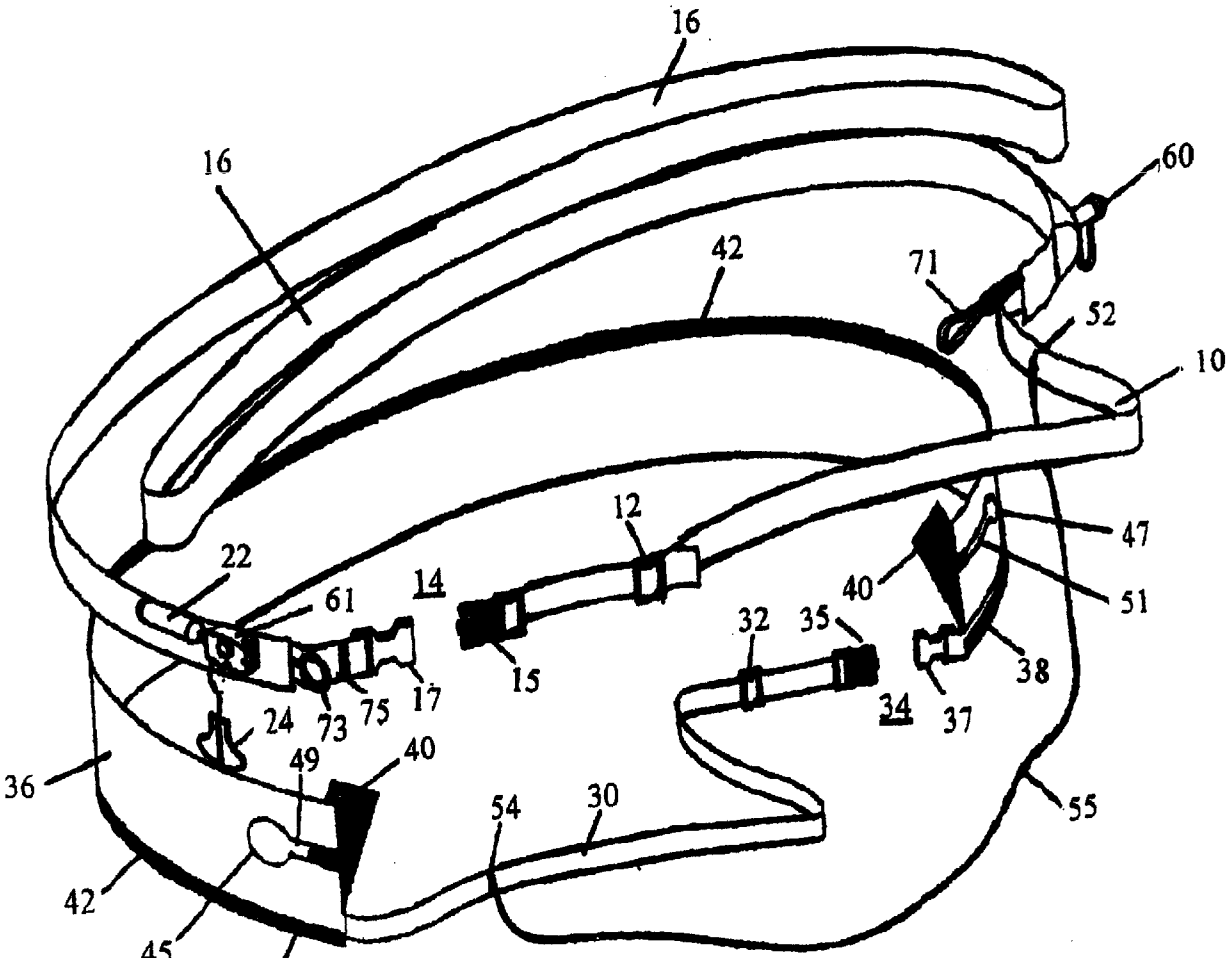
FIG. 2. PRIOR ART
Figure 3:
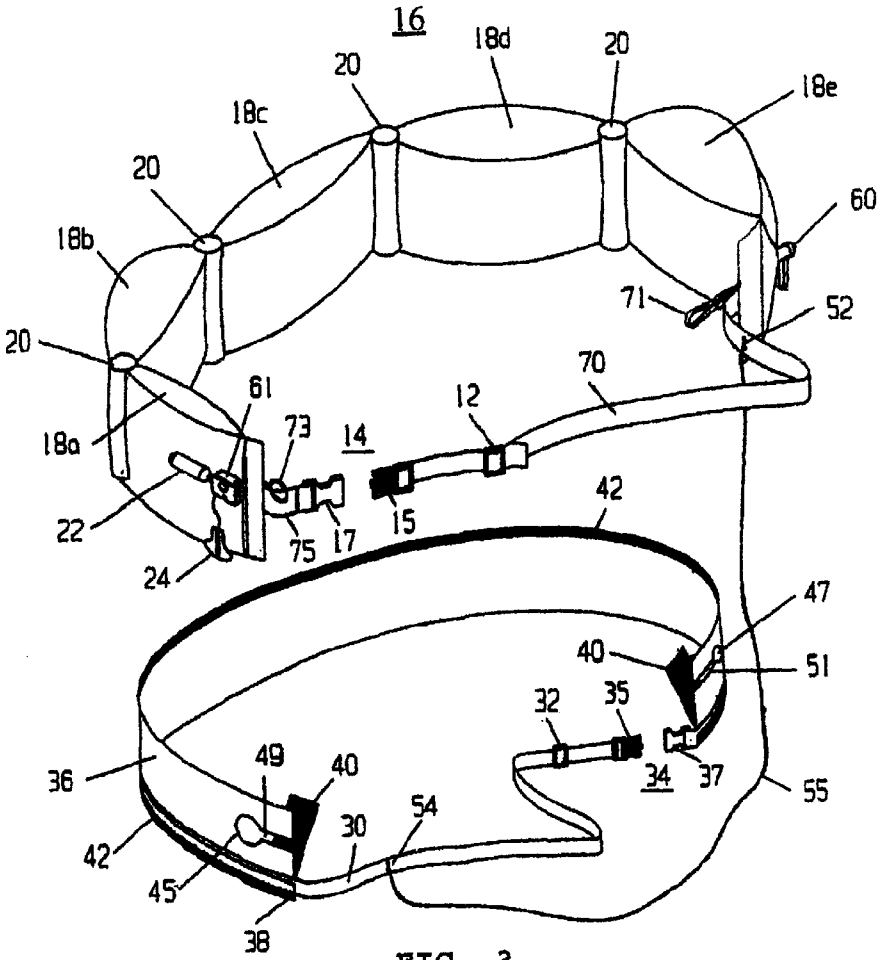
FIG. 3 PRIOR ART
Figure 4:
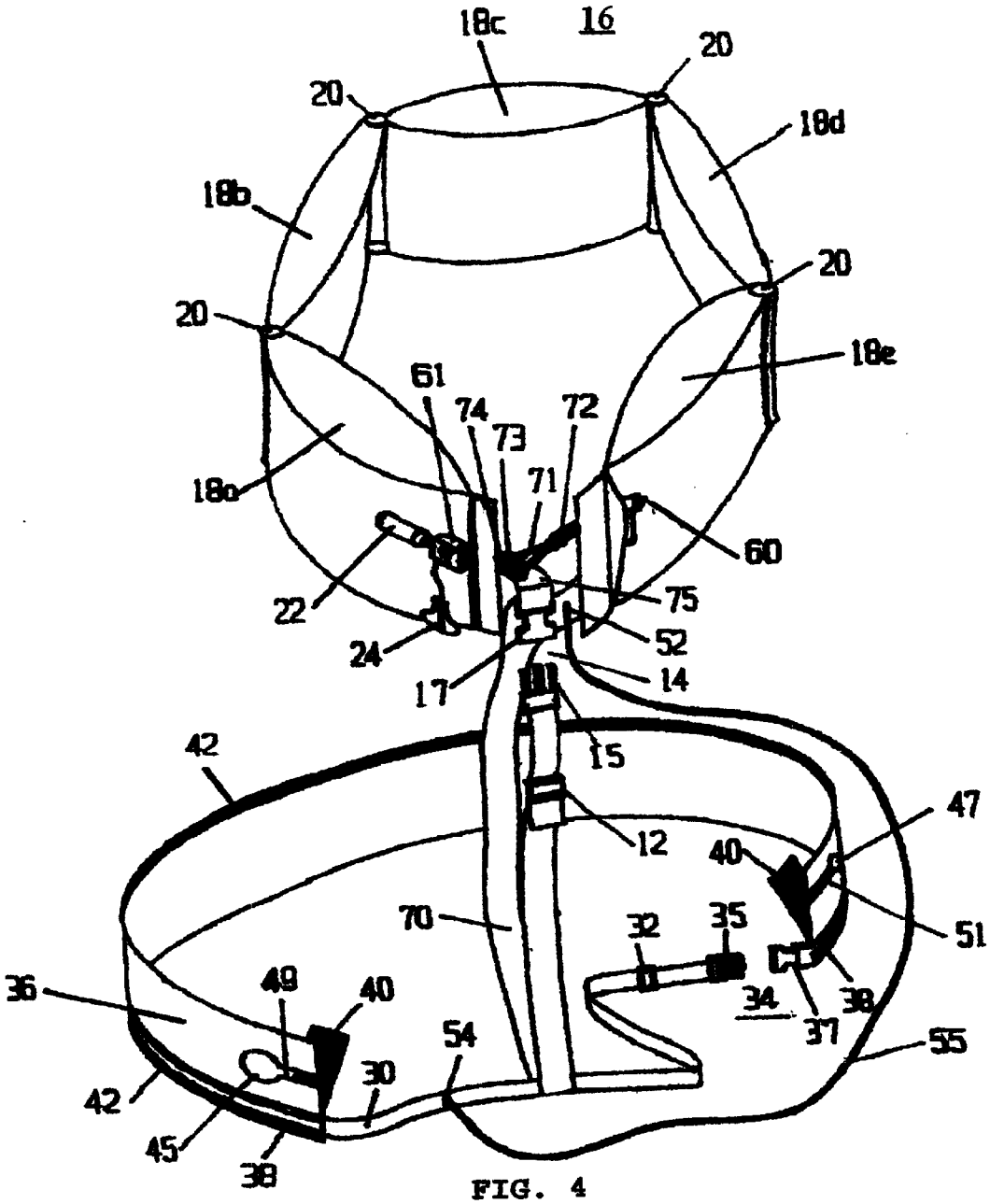
FIG. 4 PRIOR ART

In accordance with the teachings of my U.S. Pat. No. 5,702,279, a second belt 30 is also provided, similarly constructed of a rugged nylon, polyurethane-coated material or similar leak-proof composition, adjustable in length in any appropriate manner, as by the clip 32 and releasable lock 34 to encircle the waist of the wearer. This second belt 30 is of a conventional construction to be worn about the waist, underlying the first belt 10, and contradistinct therefrom in not being hollow, or sectionalized as at 18*a*-18*e*. Moreover, and as illustrated in FIGS. 2, 3 and 4 herein, this "conventional" belt 30 forms part of a jacket 36 which fits about the waist of the wearer and within which the overlapping folds 16 of the first belt are temporarily enclosed and secured (FIG. 1). To such end, and as shown in FIGS. 2, 3 and 4, the ends of the second, underlying belt 30 are fixedly secured at 38—as by a "tacking" —and including a Velcro or other adhesive fastener 40 in temporarily holding the folded section 16 of the belt 10 in place prior to deployment, in which event the unfilled sections 18*a*-18*e* are enclosed within the jacket 36, and hidden from sight. Reference notation 42 in FIGS. 2, 3 and 4 will be understood to be separate Velcro, or other adhesive securements, to wrap-over and enclose the sections 18*a*-18*e* within the jacket 36, before the puncture of the compressed gas cartridge 22. As with the releasable lock 14, associated with the first belt 10, the releasable lock 34 associated with the second belt 30 may be formed of a clasp 35 and a snap-buckle 37 of conventional design.

The inflatable swimmer's safety belt, life preserver/life vest will thus be appreciated to take on the appearance of FIG. 1 prior to actuation, wherein the first belt 10 overlies the second belt 30 about the waist of the wearer, and with the temporarily secured folded, overlapping unfilled sections 18*a*-18*e* enclosed within the jacket 36. In this respect, the second belt 30 will be understood to be a part of the jacket 36 in which the "inflatable belt" 10 is packed prior to use, and into which the "inflatable belt" is repacked after it is deflated.

Reference notation 60 in FIGS. 1–4 comprises a removable cap and nipple-type tube which permits the release of the compressed gas from the sections 18*a*-18*e* when it is desired to deflate the belt 10 for repacking into the jacket 36 after use, or to manually fill the sections by wearer's breath, as where the sections 18*a*-18*e* may tend to lose $CO_2$ gas or air in the event that the inflatable swimmer's safety belt is worn in the water for a prolonged period of time. At the same time, the jacket 36 is provided with a pair of holes 45 and 47, with adjacent slits 49 and 51, which allow the jacket 36 to freely break open when the belt 10 is to be inflated and deployed. The holes 45 and 47—together with their respective slits 49 and 51—will also be seen to accommodate the compressed gas actuator 61 controllable by the lanyard jerk 24 and the removable cap 60, respectively (see FIG. 1).

In operation, upon jerking of the lanyard 24, the compressed gas cartridge 22 not only fills the belt 10 and/or its sections 18*a*-18*e*, but also acts to unfold and expand outwardly the folded-over rectangular-like sections 18*a*-18*e*, previously held within the jacket 36. More specifically, the filling by the compressed gas which is released will be seen to unfurl the Velcro sections 40 and 42, so as to increase the length of the belt 10, to free it from the enveloping confines of the jacket 36, and to form the life preserver of increased length which results, so as to permit the belt 10 to raise over the chest area towards the wearer's arm pit level—done automatically as the inflated sections 18*a*-18*e* ride up in the water. Depending upon the amount of the hollow belt 10 initially overlapped, and on the amount of the belt 10 devoted to receive the inflating gas, the unfolding and outward expansion of the belt 10 can be predetermined, to allow the belt 10 to ride under the armpits of the wearer, and to thereby hold the wearer substantially vertical in the water. In a preferred embodiment of the arrangement described in my U.S. Pat. No. 5,702,279, the overlapping belt portions 18*a*-18*e* were selected so that with a carbon dioxide compressed gas cartridge 22, the length of the belt 10, when filled, increased by approximately 10 inches, to allow the belt 10 to rise to the armpits of the wearer, from its initial position at the wearer's waist.

Further, and in accordance with the teachings of U.S. Pat. No. 5,702,279, a tether is included between an underside surface of the overlying belt 10 (as at 52) and a topside surface of the underlying belt 30 (as at 54). Such tether, identified by the reference notation 55 in FIGS. 1–4, is selected of a length to restrict the upward riding of the belt 10 when expanded. In such manner, the tube so formed is prevented from riding over the shoulders and/or the head of the user, to become otherwise "free". The inflatable swimmer's safety belt of U.S. Pat. No. 5,702,279 could then be used as a life preserver.

In accordance with the teachings of my U.S. Pat. No. 5,702,279, the arrangement of FIGS. 1–4 can also be employed to convert the life preserver thus so formed into a life vest for those situations where needed. In FIGS. 3 and 4, in particular, the lock 14 of the first belt 10 can be released, and its strap 70 coupled over and under, about the belt 30—vertically—to then be closed again and tightened through the clip 12 to maintain constant the distance between the belt 30 and the then re-joined lock 14. Means are provided, at the same time, on the inflated belt 16, to essentially maintain the life preserver shape formed when the inflated belt 16 is secured through the horizontal closing of the lock 14, in the manner shown in FIG. 3. Such configuration can be maintained through releasable couplings provided adjacent the opposite ends of the inflated belt 16, as by a snap-hook 71 secured to the belt 16, at an underside 72 overlapped by the strap 70. In like manner, a ring 73 can be secured at an opposite underside 74, beneath the closure end of the strap 75 where the lock 14 is, secured.

In such manner, as shown in FIG. 4 then, the life preserver previously formed by the sections 18*a*-18*e* can be raised above the armpits of the wearer, but restricted to the shoulder and neck area by the strap 70, 75 in holding the inflated sections about the neck.

Further reference should be had to my U.S. Pat. No. 5,702,279 in understanding the specific manner in which the life preserver of the inflatable swimmer's safety belt of FIGS. 1–4 is converted to the life vest to support an unconscious or overly tired wearer. Similar reference should be had for understanding how, when the wearer's strength is regained, the conversion can be reversed back from the "life vest position" to the "life preserver position", so as to allow the wearer to begin swimming anew, until tiring later on, to convert the inflatable swimmer's safety belt back to the "life vest position", etc. A reference to FIGS. 11–18 of that patent is quite helpful in this respect.

While the safety belt of my U.S. Pat. 5,702,279 performs quite well, it will be appreciated that its primary use is for swimmers, who need a flotation ring or life preserver for "quick-rescue" purposes, being convertible to the life vest when the swimmer is disabled for a considerable period of time. In such respect, pulling on the lanyard 24 immediately and automatically deploys the inflatable belt as a life preserver without the wearer having to do anything else. On the other hand, a series of steps are required to convert the life preserver into the life vest on those occasions where needed—and as described in that patent, involves some 5 additional movements: opening the lock arrangement 14, pulling the clasp 15 down and around the waist strap 30, pulling the clasp 15 up again, resnapping the buckle 17 and clasp once more, and then tightening the strap 70.

Figure 5:
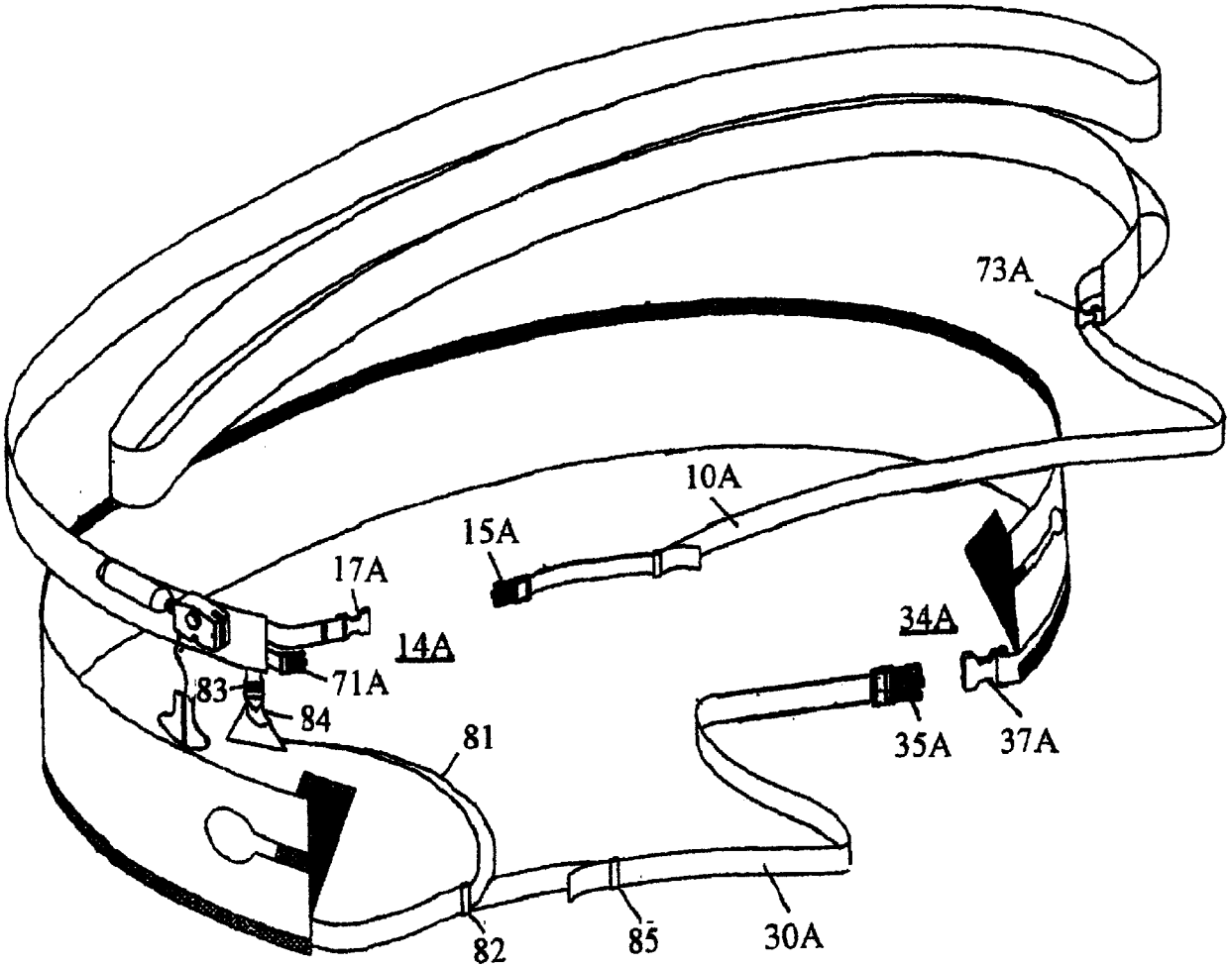
FIG. 5 PRIOR ART
FIGS. 5–6 are perspective views helpful in an understanding of the 2-step swimmer's safety belt of my U.S. Pat. No. 6,036,562, which also serves as prior art to the present invention.
Figure 6:
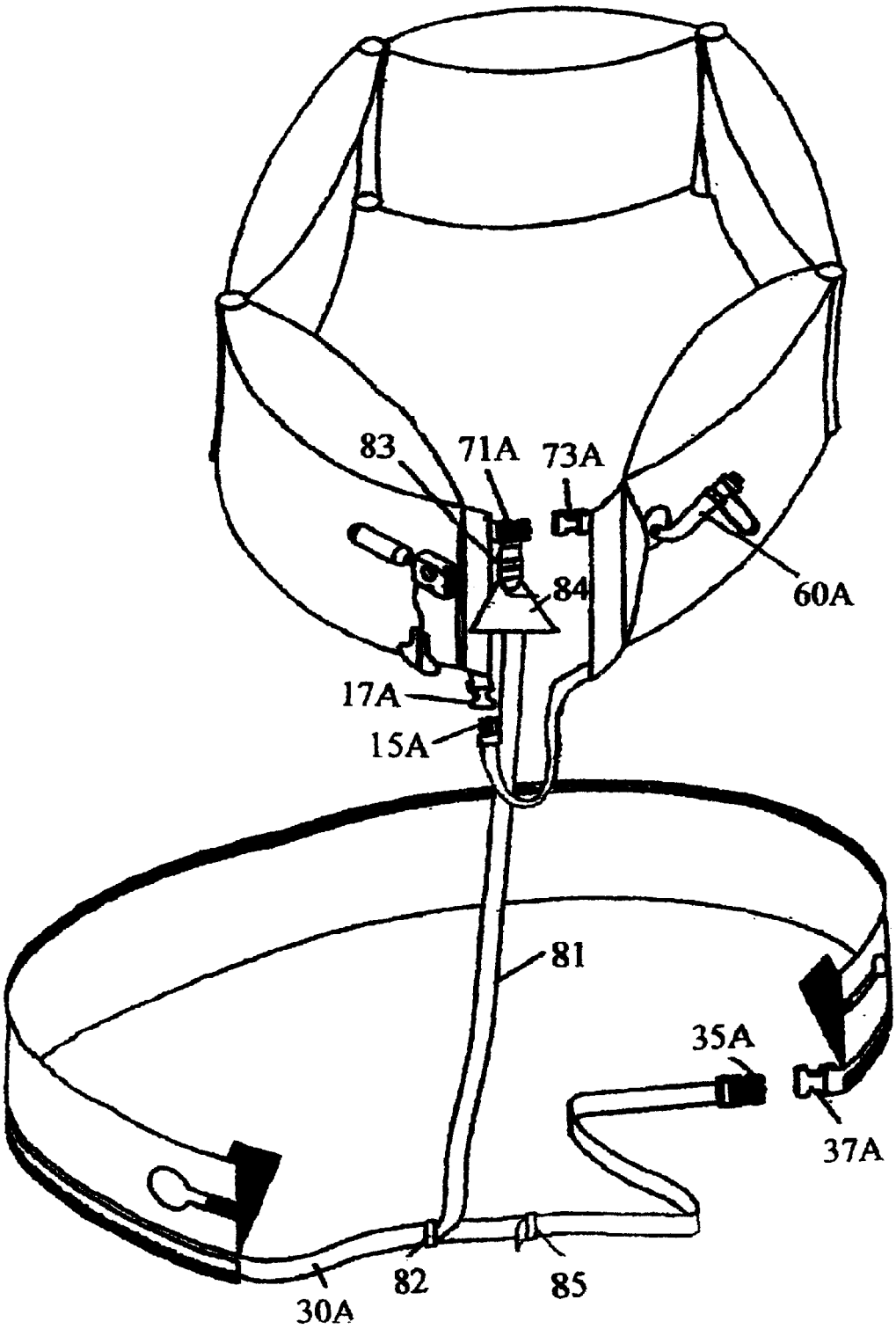
FIG. 6 PRIOR ART

My U.S. Pat. No. 6,036,562, on the other hand, set out a construction which enabled these last five steps to be effectively eliminated in converting the "life preserver" to the "life vest" while allowing for streamlining the repacking of the belt after use. While referring to its FIGS. 12–17 and the accompanying description illustrate the manner of converting the life preserver aspect of that invention to its life vest mode of operation without these five steps, the benefits obtained follow from the showings of FIGS. 5 and 6 of this Application, which are perspective views helpful in understanding the manner of its beneficial modifications. With FIG. 5 appreciated to be a modification of the prior art construction of FIG. 2 and with FIG. 6 being understood to be a modification of the prior art construction of FIG. 4—and recognizing that the 2-step swimmer's safety belt of U.S. Pat. No. 6,036,562 is particularly suited for swimmer's caught in riptides, or cramping while swimming, who primarily just need a quick rescue flotation ring to return to shore—, these modifications from the U.S. Pat. No. 5,702,279 arrangement include the following:

a. In the arrangement of FIG. 2, the releasable clasp 15 and snap-buckle 17 employed with the overlying belt 10, and the releasable clasp 35 and snap-buckle 37 employed with the underlying belt 30 were all the same size. In accordance with the teachings of U.S. Pat. No. 6,036,562, different sizes were employed, to make the donning of the safety belt simpler, by identifying the larger lock to be the first choice in placement, followed thereafter by the smaller lock.

b. In the configurations of FIGS. 5 and 6, the snap-hook 71 and the ring 73 of the U.S. Pat. No. 5,702,279 construction were replaced by a lock arrangement including a snap-buckle 73A and a clasp 71A, to make matters easier, especially when parts are wet (as in the water), where the snap-hook 71 of FIG. 2 exhibited a tendency to slip and slide about the ring 73 when attempting to exert manual force and dexterity in joining them together.

c. The nipple-type tube of the U.S. Pat. No. 5,702,279 invention through which the wearer would blow to inflate the belt with breath air where the compressed air leaked or the belt otherwise deflated was replaced in FIG. 6 by a longer tube 60A, to simplify use.

d. And, the tether 55 of the U.S. Pat. No. 5,702,279 construction of FIGS. 2 and 4 was replaced by a drawstrap 81 coupled to the belt 30A by a movable box slide 82. Secured to the belt 10A was a lock slide 83 through which the drawstrap 81 passed, with a tab extension 84 on the drawstrap 81 being pulled downward for drawing the belt 10A towards the belt 30A until snug to the wearer, and to lock the drawstrap 81 in place. As described in detail in my U.S. Pat. No. 6,036,562 disclosure, the drawstrap arrangement—instead of having to unsnap the clasp 15 in FIG. 4, pulling its strap 70 down, under and around the belt 30 and up again, before resnapping it back together and then adjusting the strap to size by the clip 12—all became unnecessary with the arrangement of FIGS. 5 and 6 where one simply had to draw down on the tab extension 84 until the drawstrap 81 was snug.

As will become clear from the following description, the inflatable personal flotation device of the present invention is intended more for use not as a life preserver initially, allowing the wearer to swim about, but as a life vest for those persons who may be accidentally knocked into, or who jump from a boat into, an open water environment in an emergency situation, and who may be stranded there for some time before rescue. As will be seen, the inflatable personal flotation device of this invention inflates to a life vest in a simpler manner than does the swimmer's safety belt of my U.S. Pat. Nos. 5,702,279 and 6,036,562 constructions. As will be understood, one aspect of this follows by having only a single belt, containing a folded rectangular, oblong, elongated or oval-shaped inflatable cell which, upon actuating the compressed gas cartridge inflates into a life vest which is then donned by pulling over the head and about the neck, without using two separate belts. A second aspect also will be seen to follow from improving upon the drawstring of U.S. Pat. No. 6,036,562, by eliminating the need to secure it to this waist jacket belt by a slide box.

Figure 7:
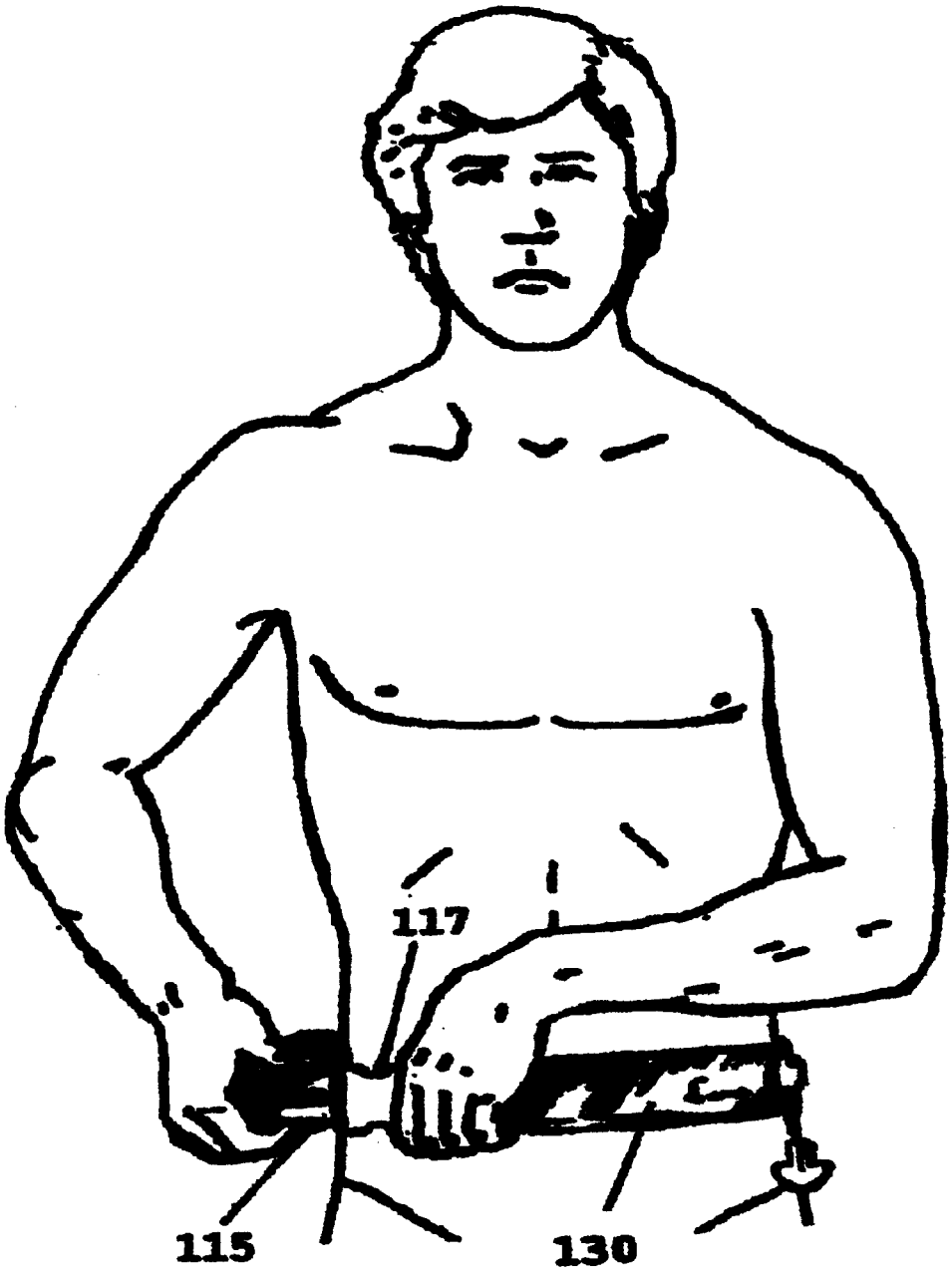
FIGS. 7–13 are illustrations helpful in understanding the manner of using the safety belt of the present invention, showing the modifications made which lead to the preferred embodiment described.
Figure 8:
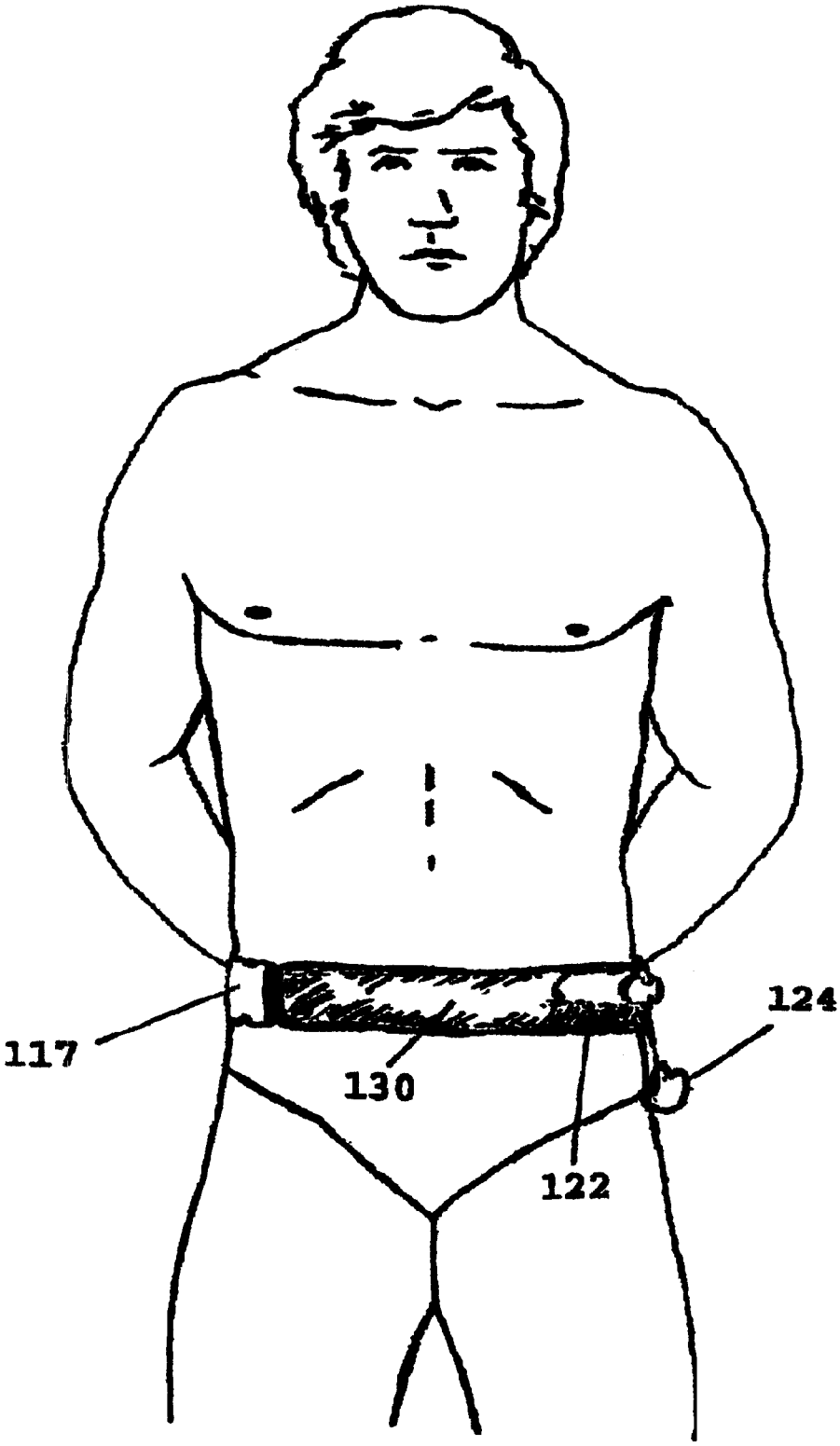
Figure 9:
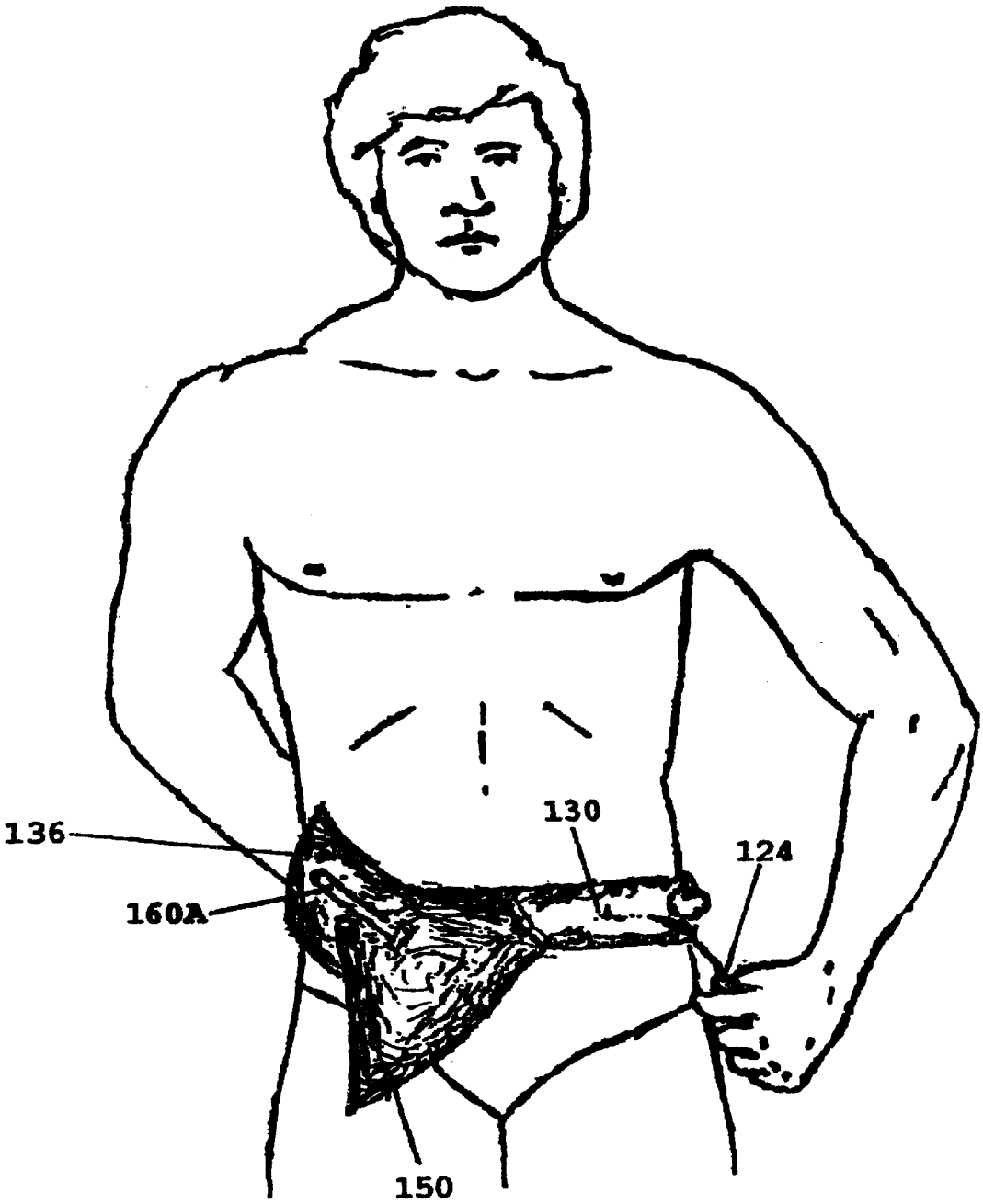

Thus, FIG. 7 illustrates the donning of the 1-step belt of the invention, by a closure of the clasp 115 and snap-buckle 117 in a manner forming a belt 130 of a jacket and adjustable waist strap, as in the prior art design of FIGS. 1–2. FIG. 8 illustrates the belt as worn, with the lanyard 124 extending down the side, and with the understandings that the compressed gas cartridge 122 lies adjacent the hip and that the belt 130 faces outwardly from the front. In FIG. 9, the lanyard 124 is pulled, to puncture the compressed gas cartridge and inflate the life vest folded inside the jacket 136 of belt 130 as a rectangular, oblong, elongated or oval-shaped cell. Thus, the life vest begins to deploy from its jacket 136, which starts to fall away from the strap 137 holding the belt 130 about the waist. Reference numeral 160A identifies the nipple-type tube through which a wearer blows to inflate the life vest with breath air (in the event the compressed air leaks or the life vest otherwise deflates)—and its increased length as compared to the nipple-type tube 60 of the prior art constructions FIGS. 3 and 4. This added length simplifies its use as being reachable by the wearer whether the inflated life vest is deployed correctly in front of the wearer (FIG. 10), or whether the inflated life vest becomes vertically twisted around 180° in reverse. As distinct from the prior art construction of FIGS. 1–4, and 5–6, it will be noted that only one belt is used—130—instead of the two belts 10 (10A) and 30 (30A) as characterized in my U.S. Pat. Nos. 5,702,279 and 6,036,562 manufactures.

Figure 10:
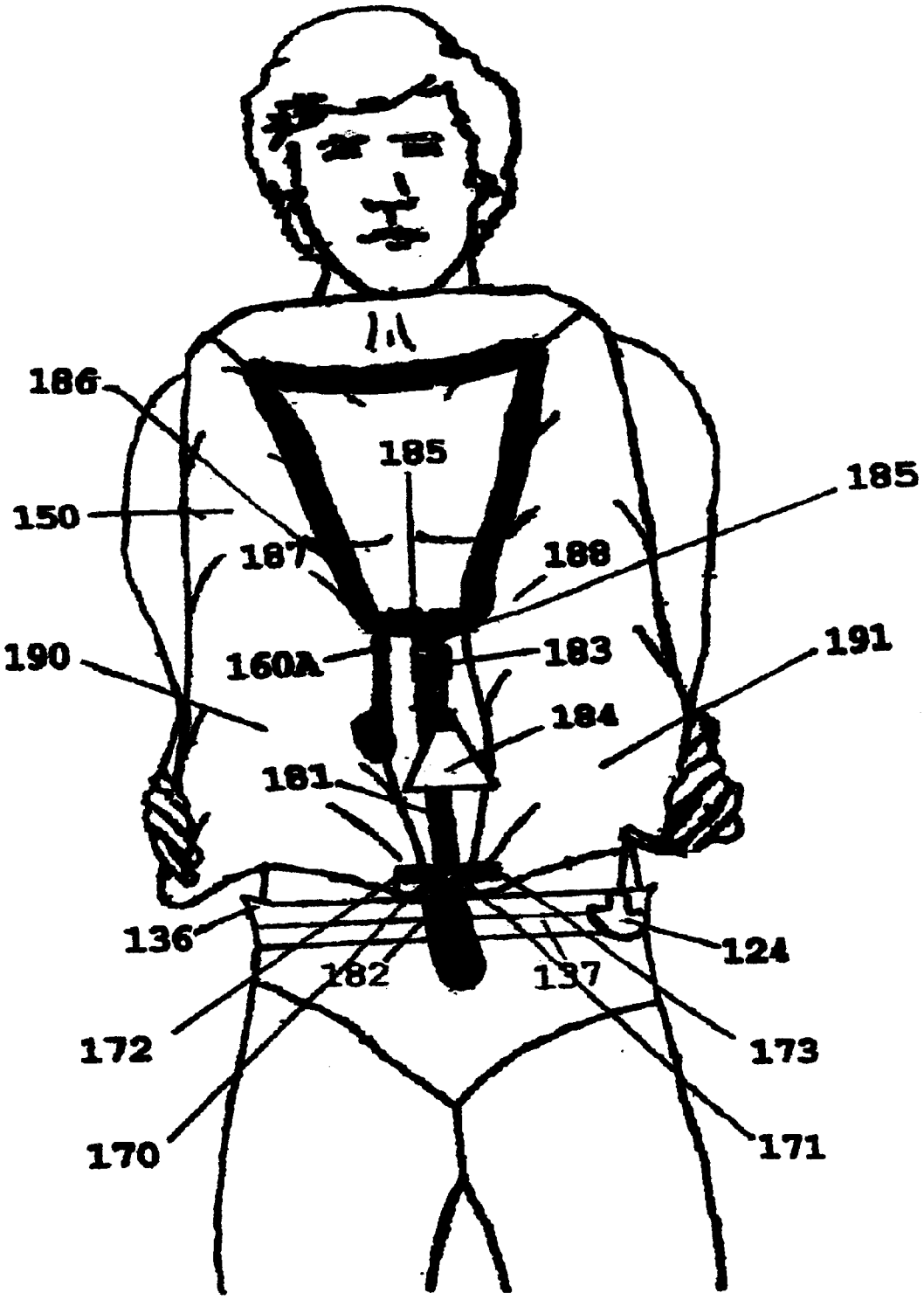

In FIG. 10, also, the two parallel straps 170, 171 which are placed on top of each other and are secured to each life vest side 190 and 191 by box stitches 172, 173 for the purpose of bringing together the sides of the life vest into a tight configuration, and also to allow the drawstrap 181 to move freely in the space between said straps. In addition, the previous tether 55 (which secured the inflated belt 10 to the waist belt 30, as in FIGS. 1–4) is replaced by a drawstrap 181, which is anchored to the waist strap 137 by a box stitch 182 fixed at its inside center, along with a tab extension 184 which, when pulled serves to tighten the drawstrap 181 until snugly in place. To this end, it will be understood that the drawstrap 181 extends from a lock slide 183 secured to a neck strap 186 by a smaller strap 185 in a manner such that pulling the tab extension 184 downward tightly secures the life vest 150 around the wearer's neck. This follows from the neck strap 186 being secured by the box stitches 187, 188 to the top side of the 2 wing sections 190, 191 of the personal flotation device. In this manner, the 2 wing sections 190, 191 are brought towards one another as the drawstrap 181 is pulled.

As will further be seen in FIG. 10, the snap-hook 71 and the ring 73 of FIG. 2 (which were joined together when the life preserver was secured about the wearer's neck as the life vest, and then released when the safety belt was taken off after use) have been replaced by the strap 186, or length of webbing, that brings together the two wings 190, 191 into the configuration of a life vest, thereby eliminating the extra donning step of snapping together a neck snap buckle 71A and clasp 73A as required in U.S. Pat. No. 6,036,562. Such change has been found to make matters easier, especially when parts are wet (as in the water), where the neck snap buckle and clasp required a measured amount of manual force and dexterity to work its securement and later, its release. Additionally, as the inflated life vest is not intended to encircle the wearer's body initially as a life preserver, the neck clasp and buckle are eliminated—as previously mentioned.

Figure 11:
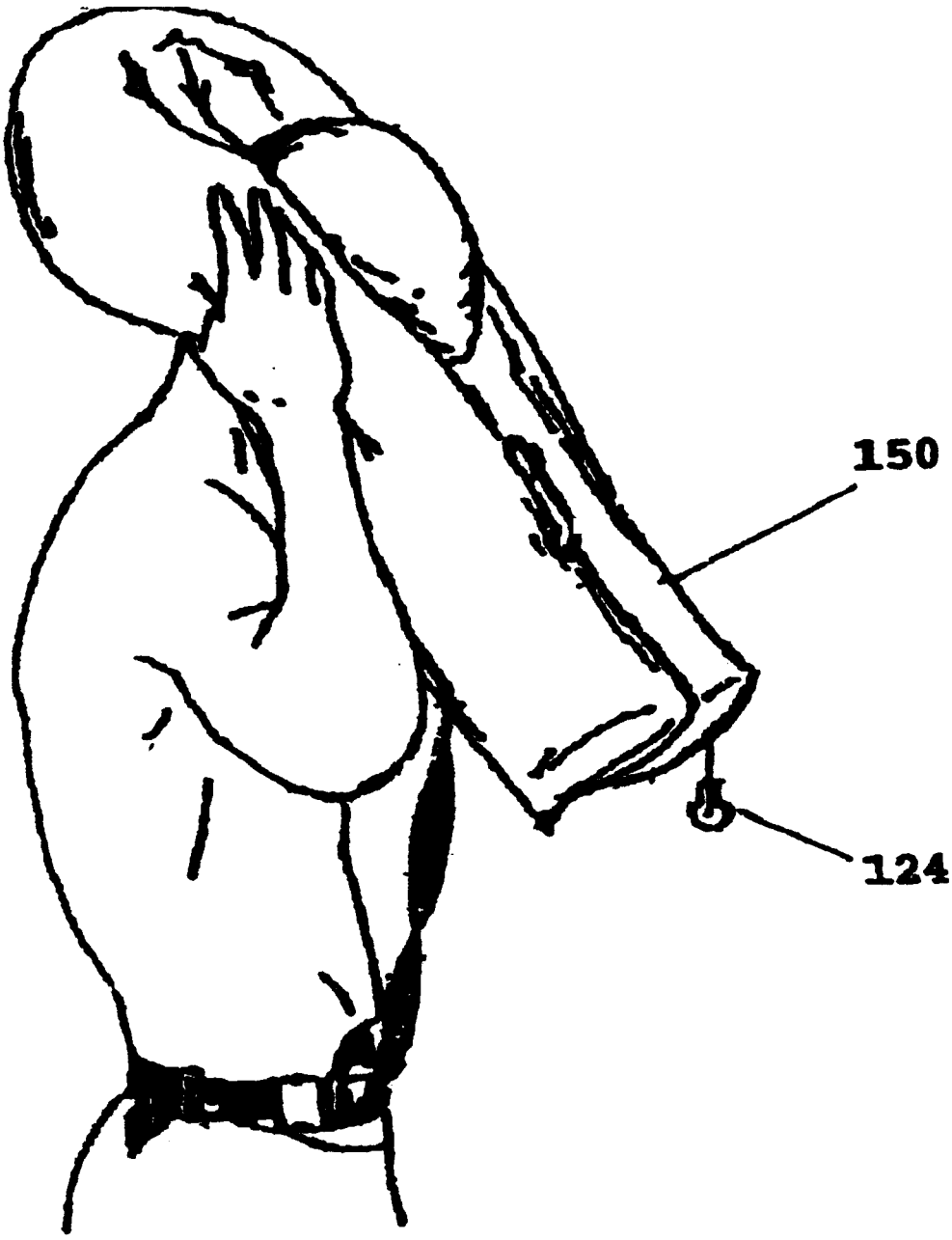
Figure 12:
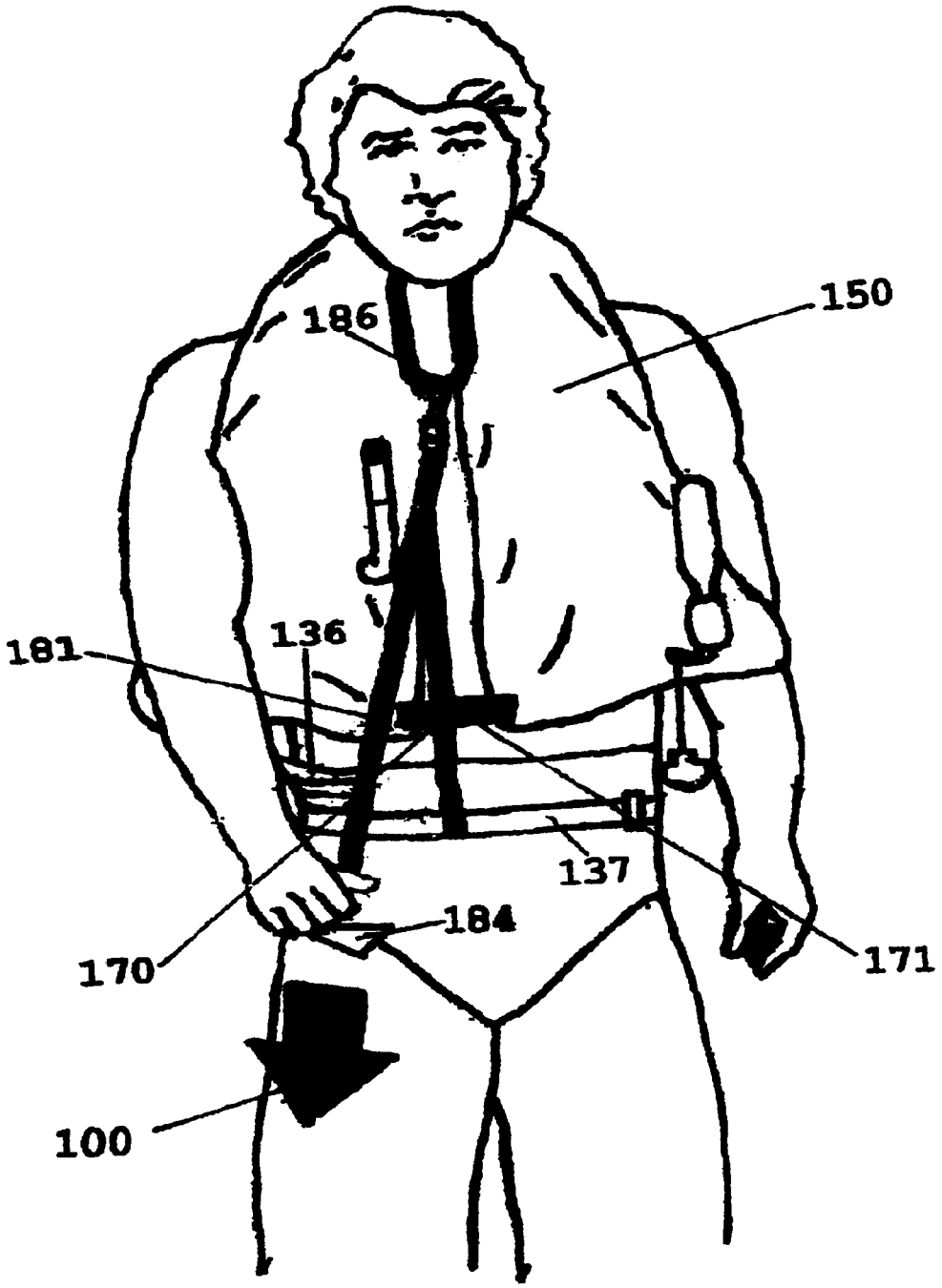
Figure 13:
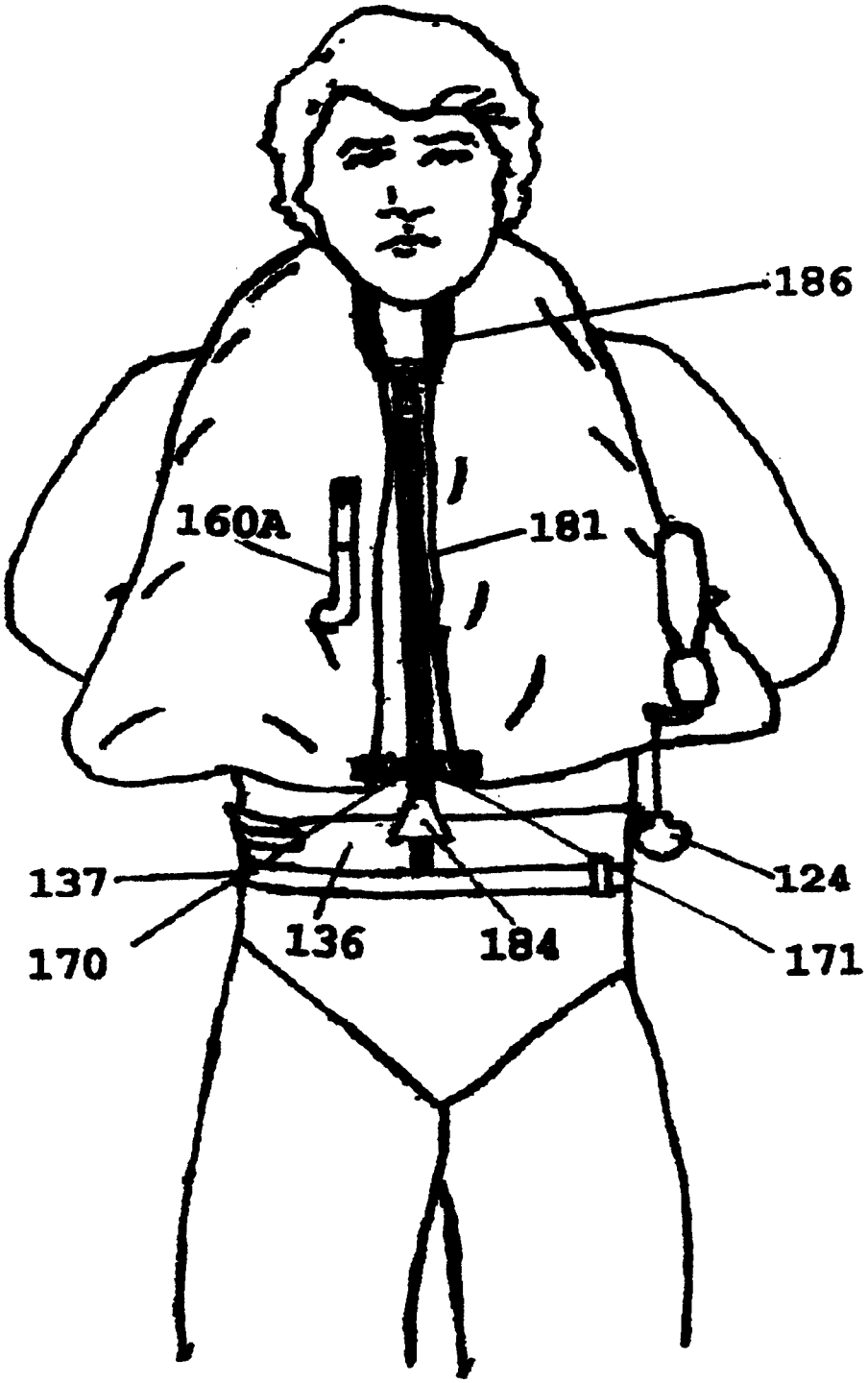
Figure 14:
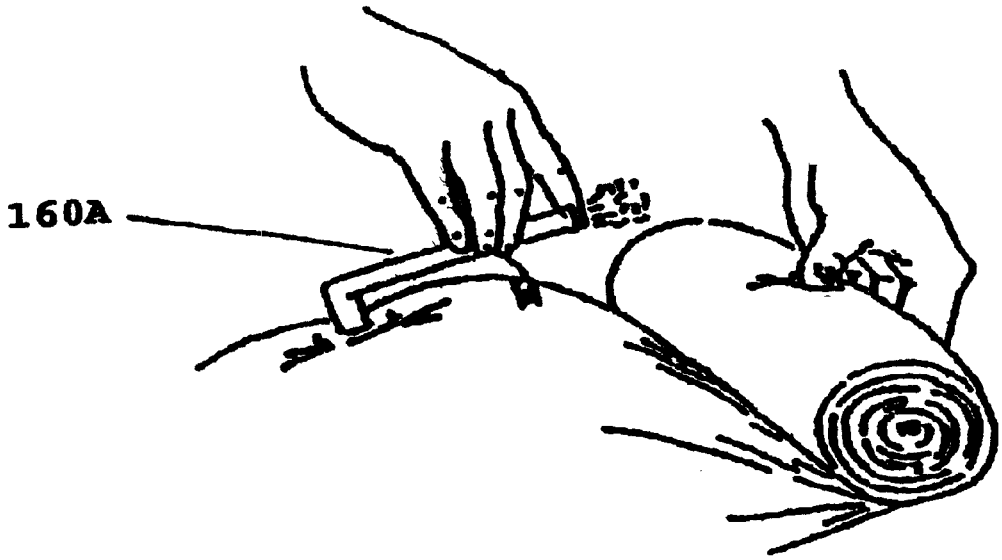
FIGS. 14–21 are illustrations helpful in an understanding of how the life vest of the invention may be repacked inside the waist jacket belt for wearing about the waist after use.

FIG. 11 illustrates the placement of the inflated life vest 150 over the head and about the shoulders. FIG. 12 depicts, by the arrow 100, the pulling down of the drawstrap 181 by means of the tab extension 184, until snugly in place as fully donned in FIG. 13. The oral inflator tube 160A is shown in FIG. 13 adjacent to the wearer's mouth, and the compressed gas cartridge 122 will be understood to be entirely empty. One advantage of this configuration follows from the exposed nature of the drawstrap 181, as shown in FIGS. 12 and 13—acting as a reminder to the wearer of its presence, and its need for pulling for adjustment and securement. With its placement and with its overall length, the possibility of a wearer's forgetting that the drawstrap 181 is there and its availability for adjustment, are thus largely obviated. As FIGS. 7–13 illustrate, in deploying the 1-step belt of the invention, the inflated vest 150 is placed so that the tab extension 184 is drawn around toward the hip, the oral tube inflator 160A is oriented in the front when the inflated vest is to be pulled over the head, and the drawstrap 181 is to be pulled snug so that the vest will not slip back over the wearer's head in use.

Further ease of use follows from "highlighting" both the lanyard 124 and the tab extension 184 of the drawstrap 181. Thus, the lanyard 124 can be colored in "red", indicating where the user is to first pull, in deploying the life vest. "Highlighting" the tab extension 184 in "orange", for example, easily identifies where the wearer is to then pull next in tightening the life vest snug.

With the invention, then, it will be seen that the belt—worn in front instead of in the back—converts to the vest in 1-step, in a simplified manner of being put on. Once the lanyard 124 is pulled to inflate the life vest 150, which is then pulled over the head, the drawstrap 181 is pulled downward to secure the life vest snugly. No need is required to lower arms through any flotation ring tube, nor to snap shut a neck buckle as in my prior art inventions, which will be seen to require a 2-step process in first forming the life preserver stage before reaching the life vest position. And, as will be understood, such advantage follows no matter the size of the compressed gas cartridge employed, or of the buoyancy provided, whether it be of a 16, 25, or 35 pound amount, etc. Also, the same will be understood to be the situation, whether the cell to which the underlying belt 10 inflates is rectangular, curved, oval, or oblong, and of whatever size.

Besides its simplicity of deployment and ease of use, the construction of the present invention is such as to allow for its folding of the deflated life vest after use into a very compact, streamlined shape which allows it to be again repacked into the jacket belt around the waist, in far less bulky arrangement than typifies the wearing of a more conventional inflatable flotation device, such as a fannypack. As such, the belt of the invention can be worn for longer periods of time, and either in the front or in the back, although deployment necessitates it being oriented frontwardly, so that it inflates in the proper direction.

Figure 15:
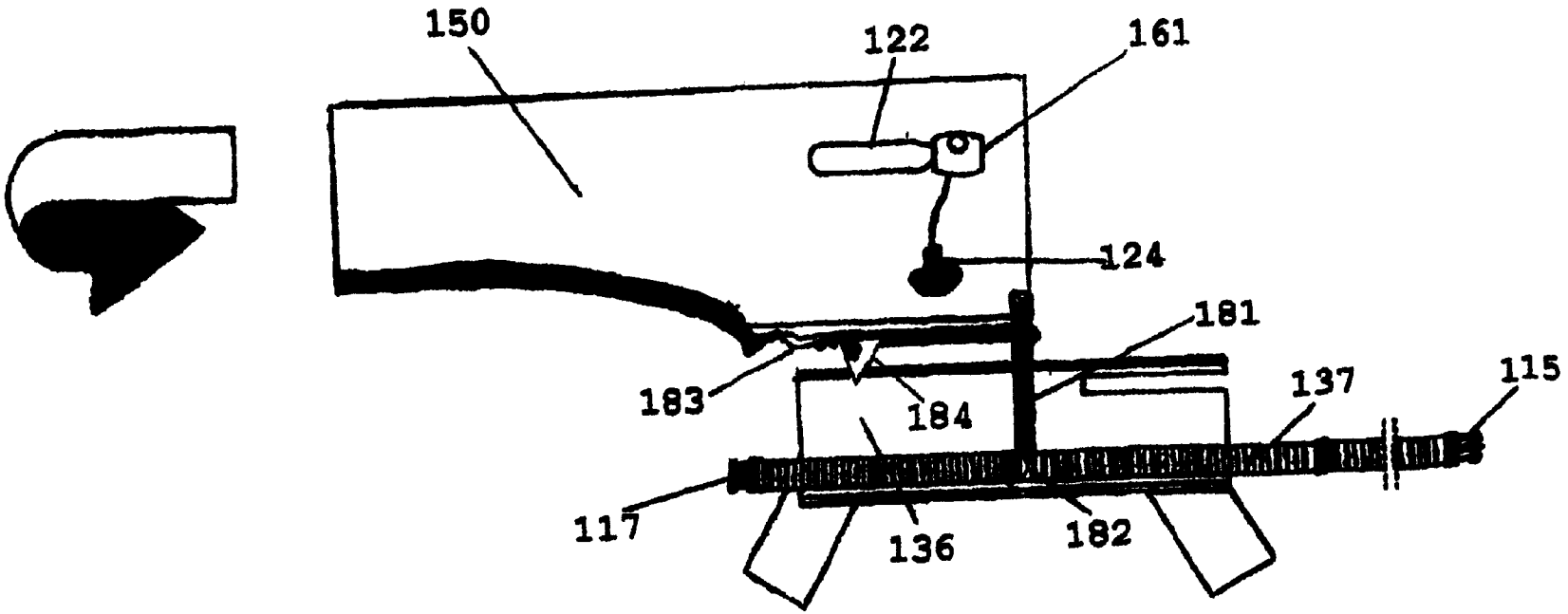
Figure 16:
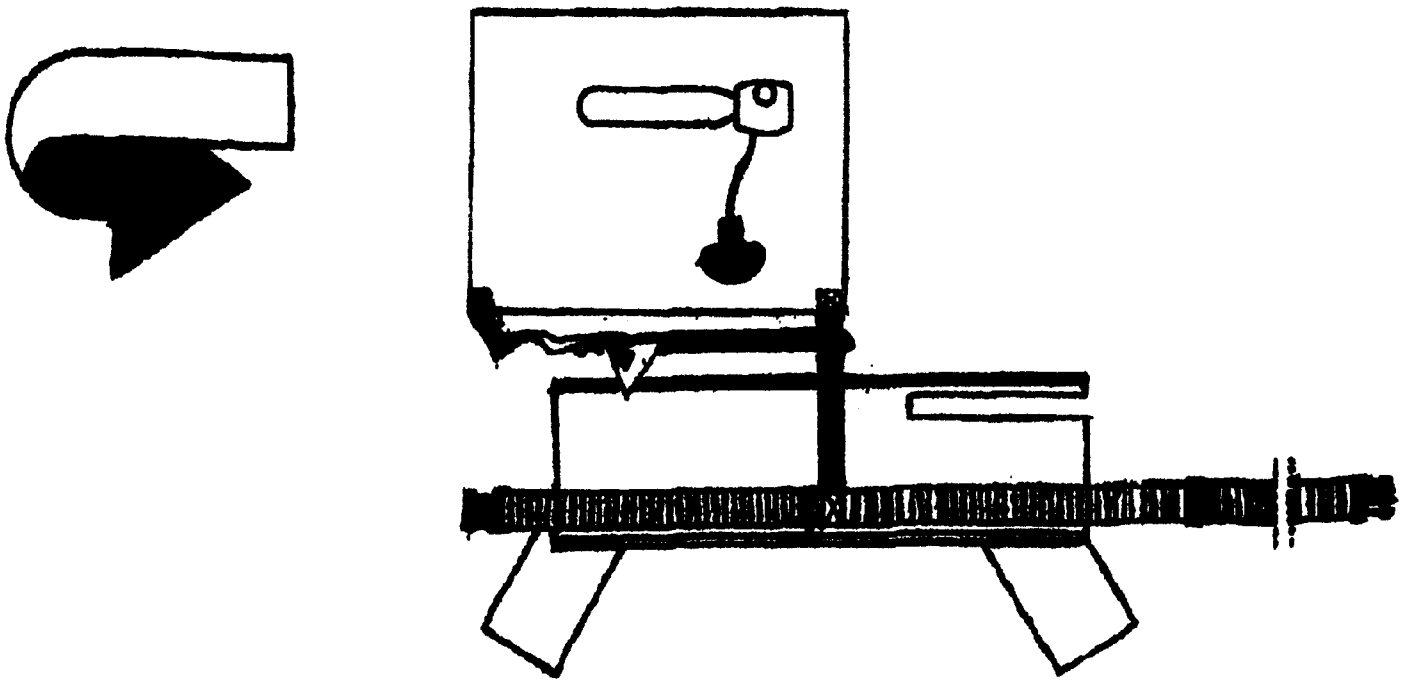
Figure 17:
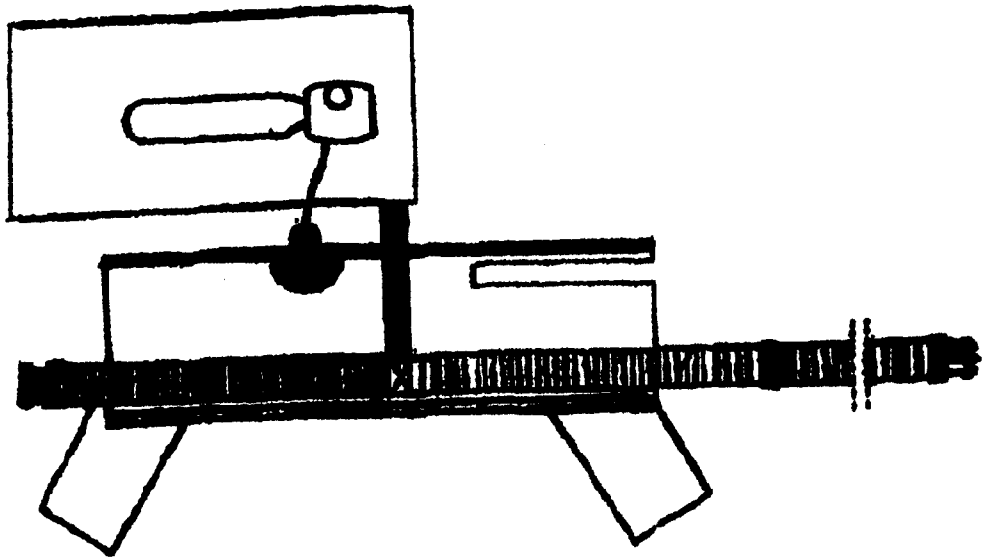
Figure 17:
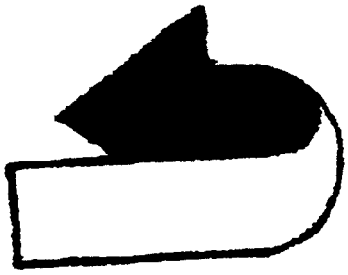

FIGS. 14–22 are helpful in understanding how to repack the life vest of the invention, after use—and, more particularly, so that with a new cartridge in place, actuating the new cartridge will deploy the life vest 150 to be donned around the neck, reliably and in the manner described in FIGS. 7–13. Thus, in FIG. 14, a finger pressing down on the oral inflator 160A deflates its valve, and the inflated life vest 150 is then compressed by hand to achieve complete deflation. The empty compressed gas cartridge is unscrewed and discarded, and a newly charged cylinder is snugly screwed back into position. Referring to FIG. 15, the waist strap 137 is then loosened, the jacket 136 is laid out, the tab extension 184 is pulled all the way back up to the lock slide 183, and the life vest 150 is folded in half with the compressed gas cartridge 122, its actuator 161 and the lanyard 124 visible on the top side and with the oral inflator tube 160A concealed on the reverse side. In FIG. 16, the deflated vest is again folded in half from left-to-right, to have all sides meet exactly.

Figure 18:
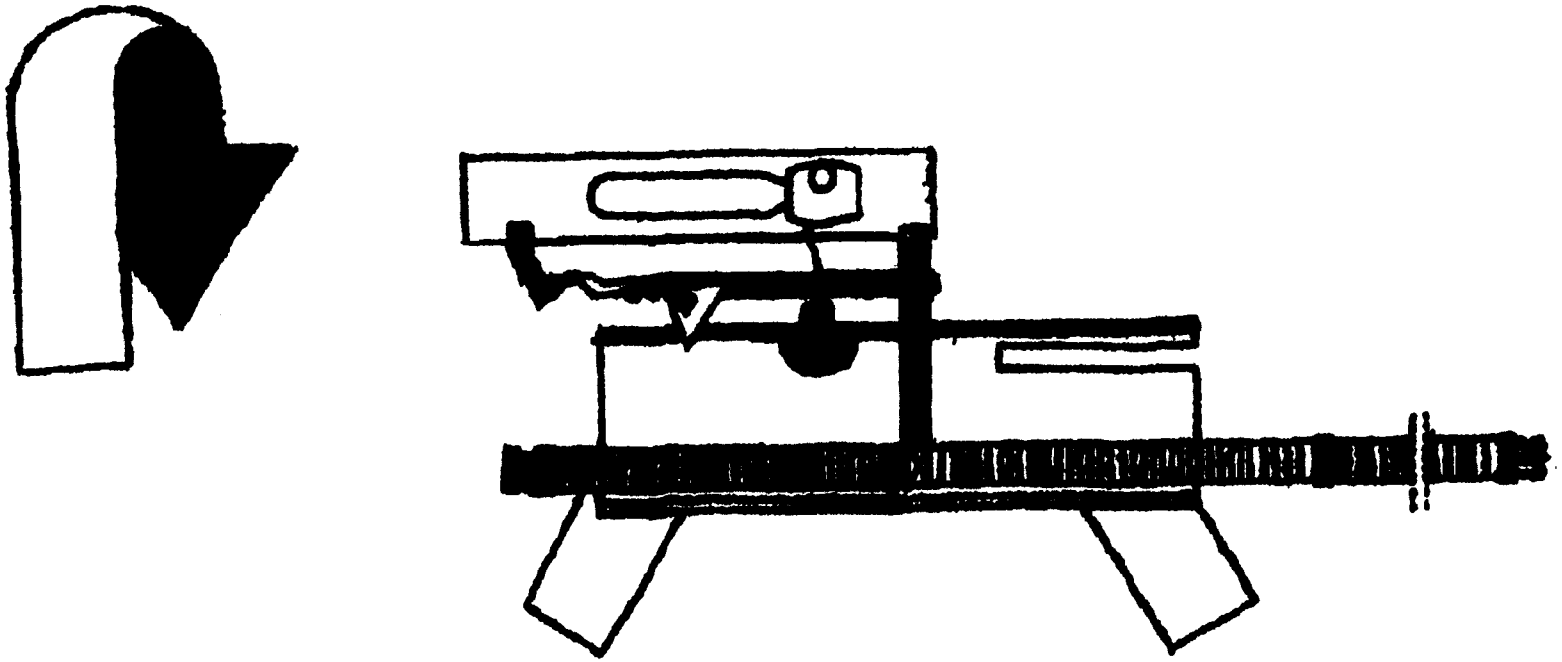
Figure 19:
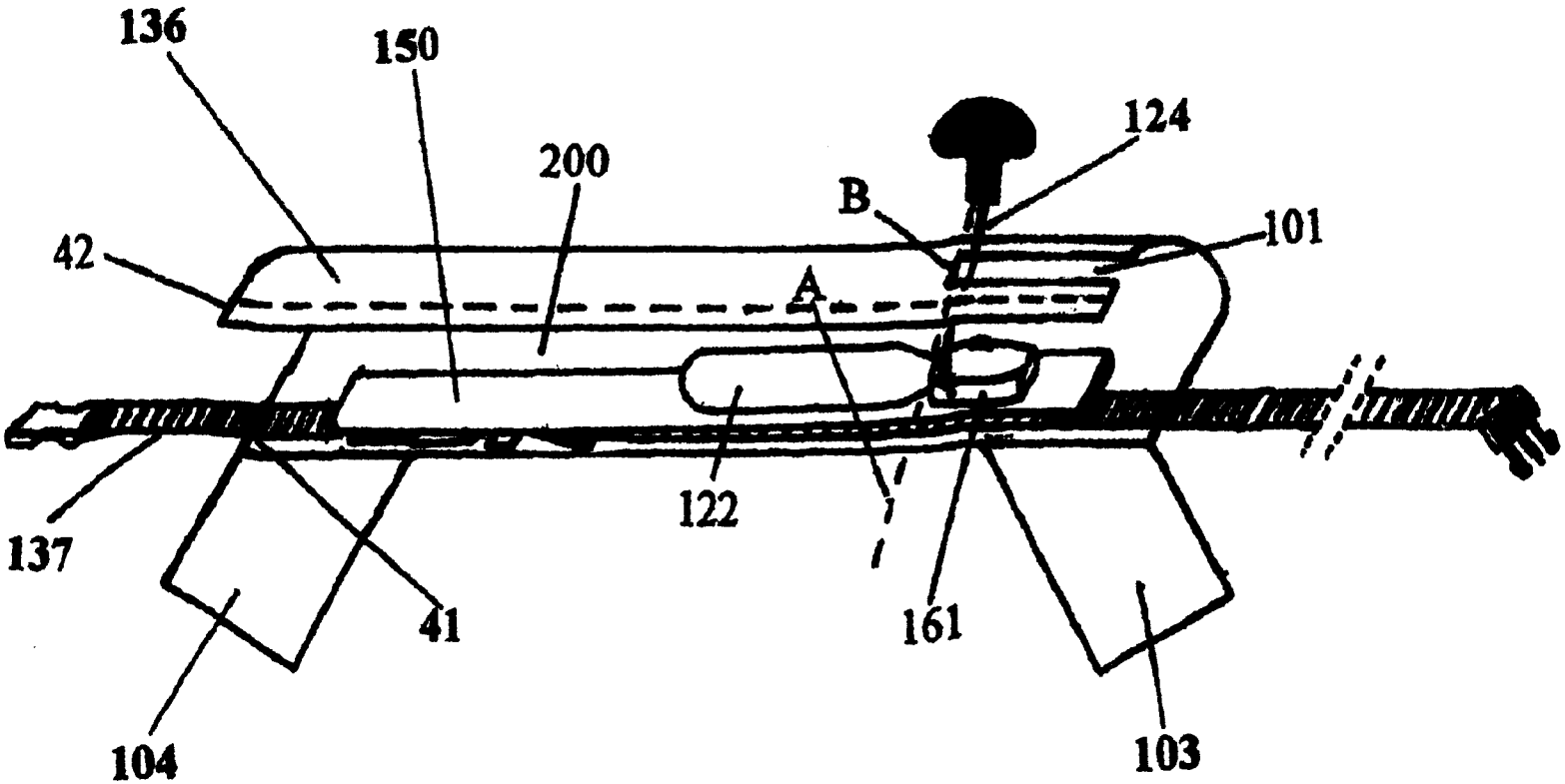
Figure 20:
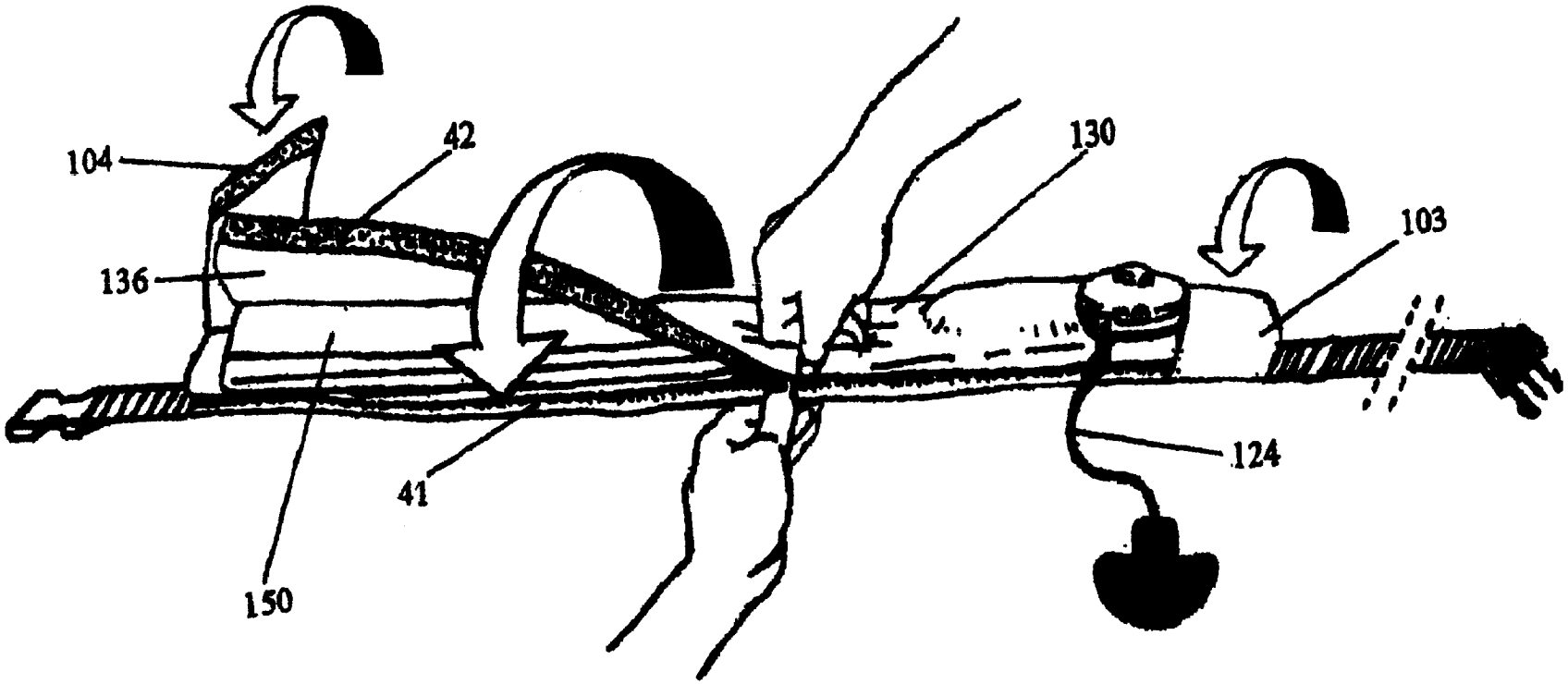
Figure 21:
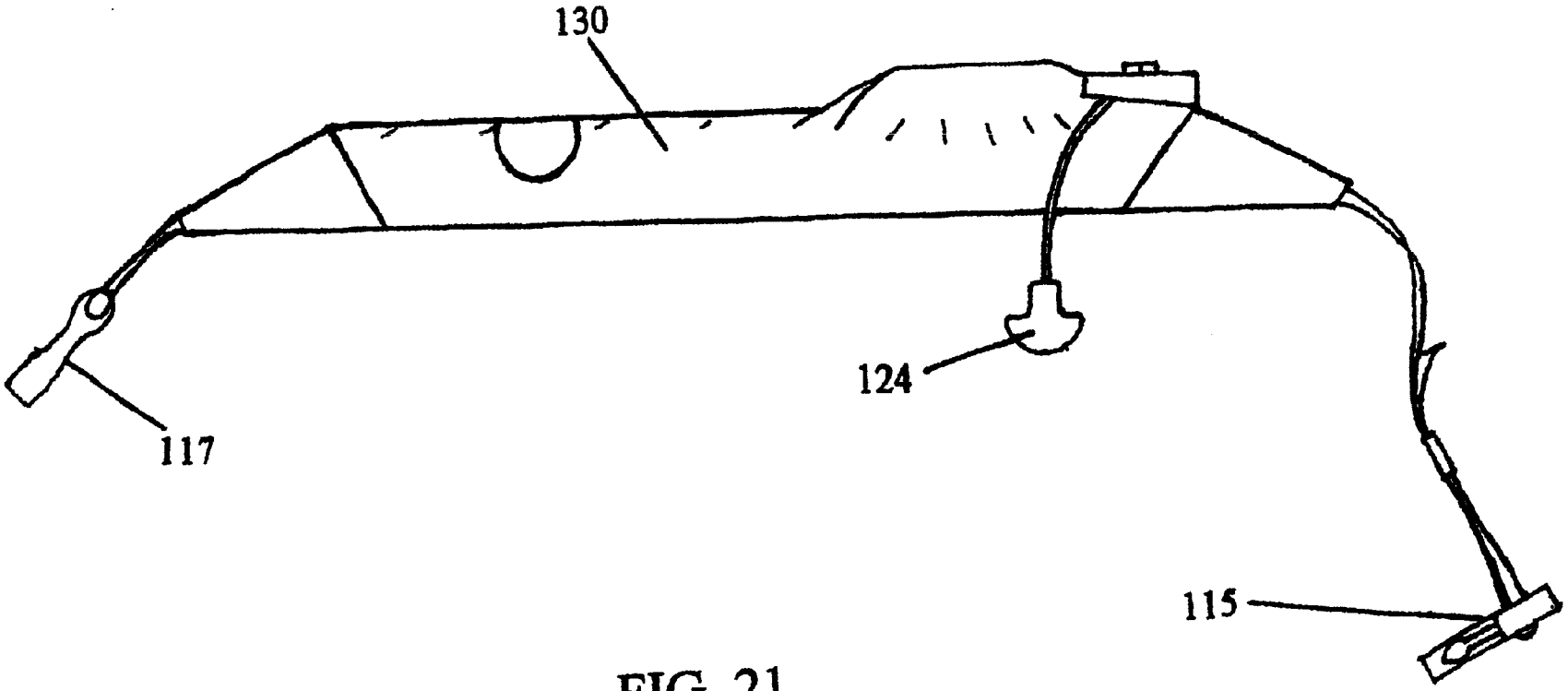

The folded life vest is then folded in half once more, underneath from bottom to top (FIG. 17), and then likewise folded in half again from top to bottom (FIG. 18). Next, (FIG. 19), the folded vest 150 is set down onto the jacket waist strap 137, beside the repacking instructions 200, with the side A of the compressed gas actuator 161 aligned with the side B of the compressed gas actuator window 101. FIG. 20 illustrates closing the jacket 136 over the life vest 150 by pulling together the two long Velcro strips 41, 42, with the lanyard 124 hanging freely on the outside of the belt 130. After the Velcro edges 41 and 42 are together, two end flaps 103 and 104 are closed at each end of the belt and also secured by Velcro strips. The closed belt 130 is then shown in FIG. 21, with the releasable clasp 115 and buckle 117 exposed, and with the lanyard 124 hanging downwardly, freely on the outside of the belt.

FIGS. 22–25 are further views helpful in understanding the repackaging of the belt for wearing and later use. In FIG.

22, reference numeral 42 identifies a first long Velcro hook strip and 41 a second long Velcro loop strip, both to be pulled together in repacking the belt, while reference numerals 103 and 104 represent a pair of Velcro flaps. A pair of webbing strips 233, 234 give weight and support to the jacket 136, and which eliminates wrinkles when the belt is being worn. Reference numerals 235, 236 identify further Velcro strips (of which the flaps 104 and 103 are a part), it being understood that two short Velcro strips 237 and 238 are incorporated on the reverse side, like the longer Velcro strip 41, which is used to secure the lower edge of the jacket 136 to the top edge with Velcro strip 42 when the belt is repacked. The male end of the waist strap 115 is shown, with the female buckle end 117. The anchor for the drawstrap 181 is in the form of the box stitch 182, with a box slide for holding extra strap length in position being illustrated at 244.

Figure 22:
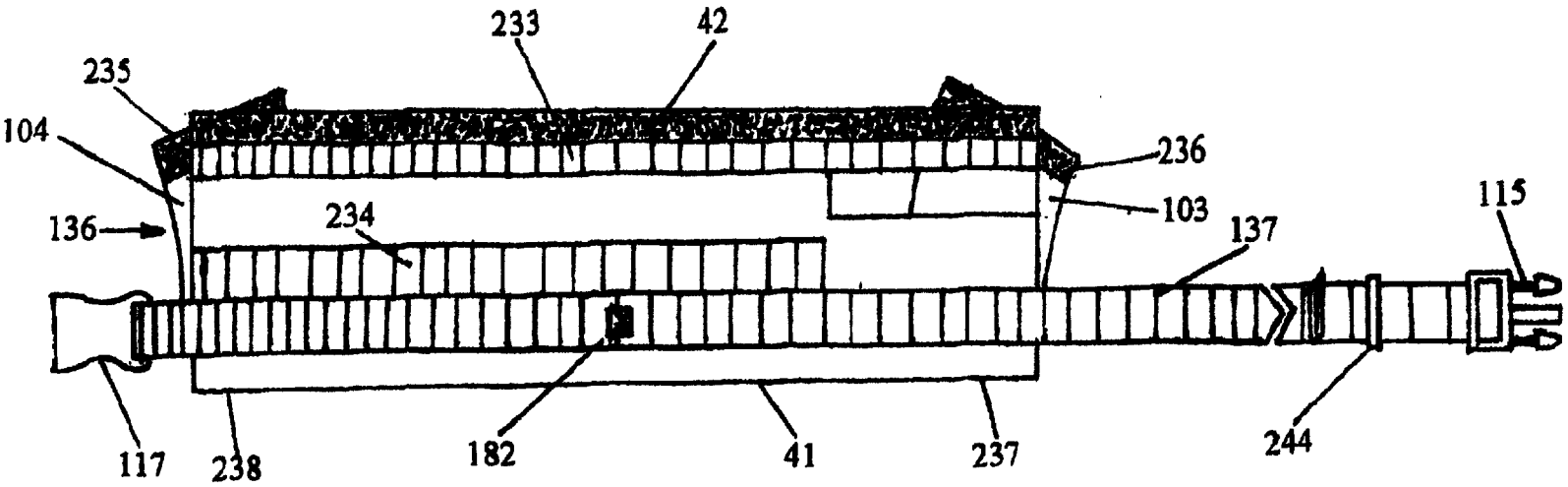
FIGS. 22–25 are views helpful in understanding other features of the invention.
Figure 23:
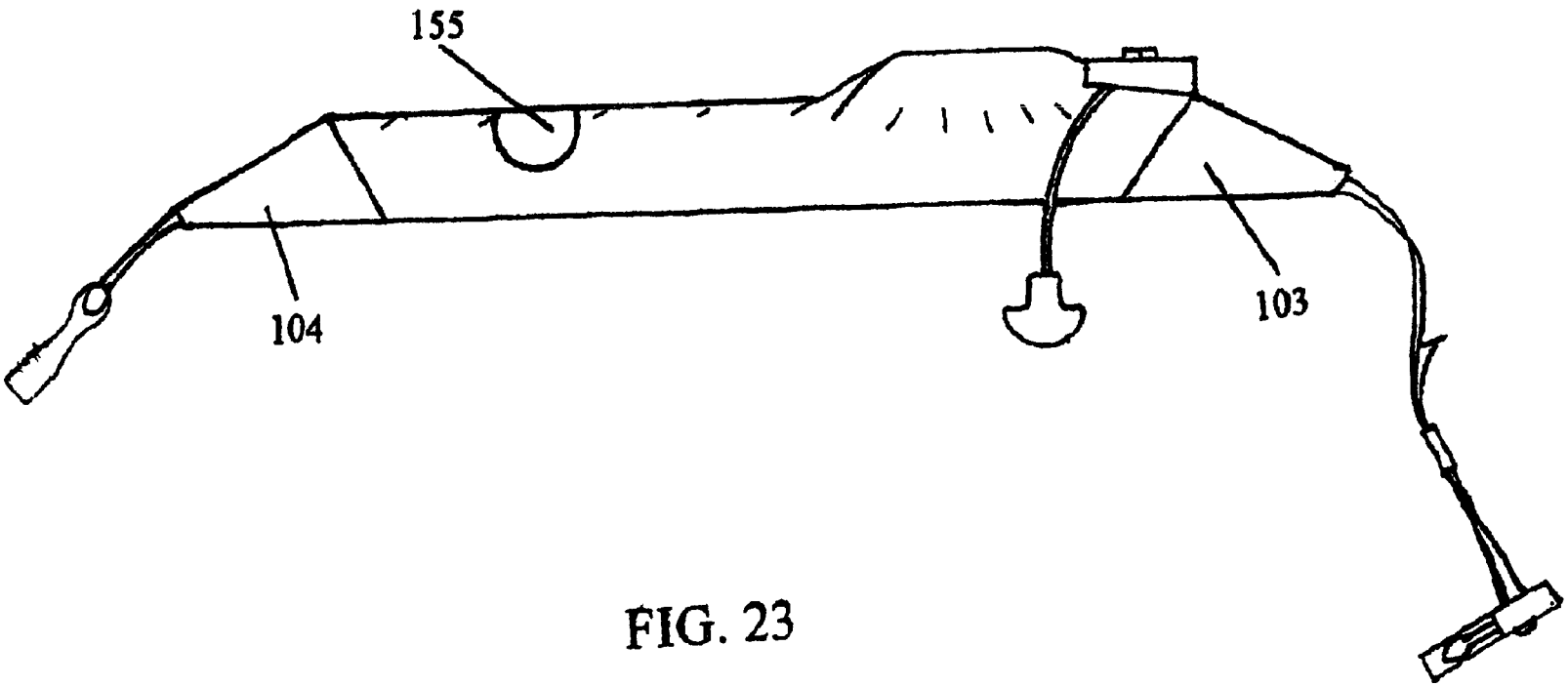
Figure 24:
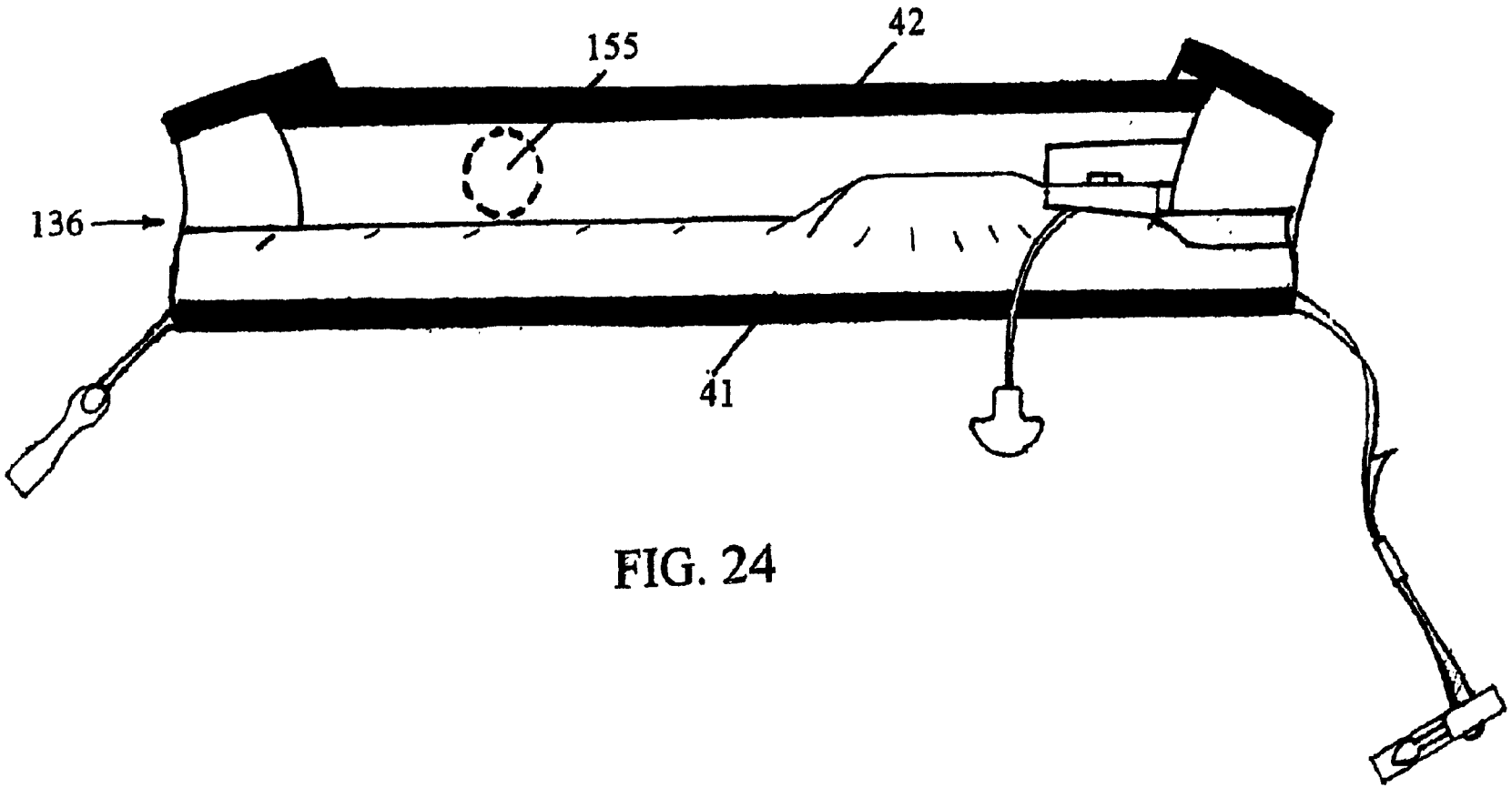
Figure 25:
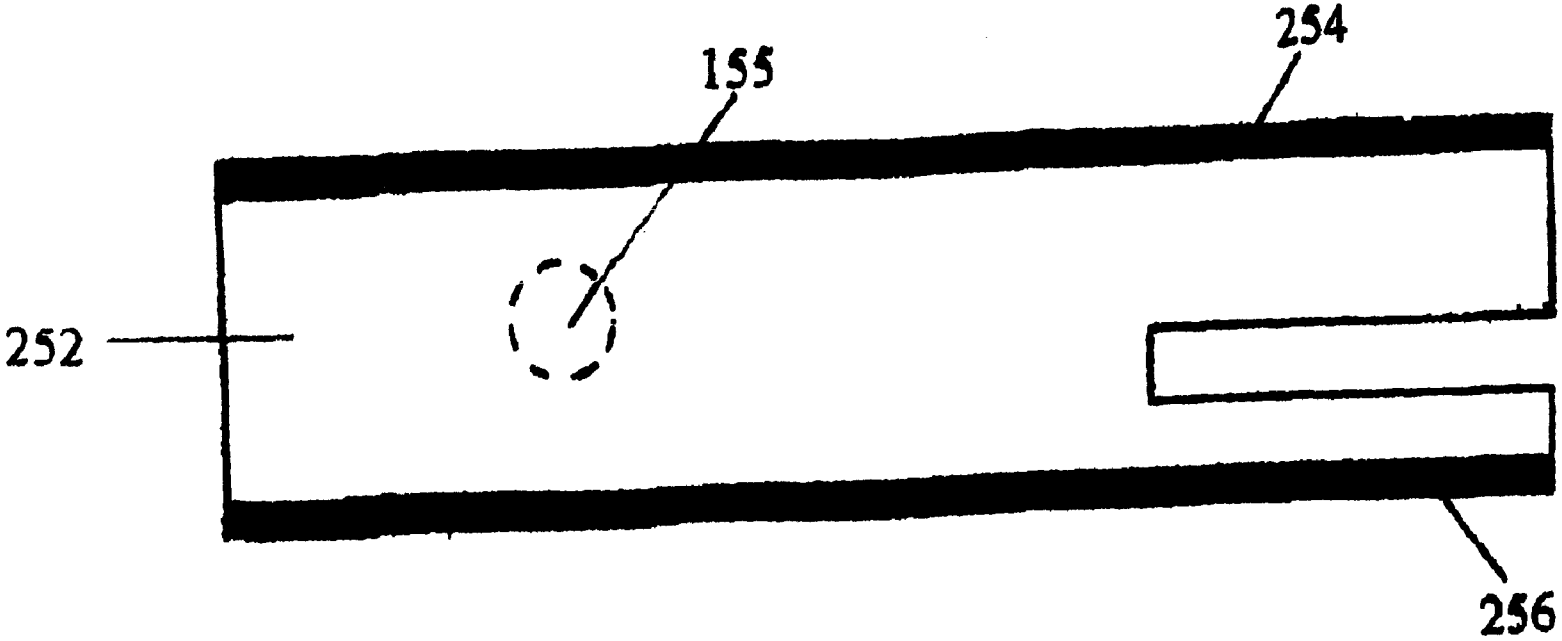

FIG. 23 is a detailed, side view of the belt of FIG. 22 as repacked, illustrating the closed nature of the Velcro flaps 103, 104 on the strips 235, 236, for securing the belt when it is being worn. Reference numeral 155 in FIG. 23 identifies a logo which may be emblazoned on the belt by a manufacturer, or on the underside of the jacket 136 in FIG. 24, or on an optional snap-on decorative cover 252 for the jacket, as shown in FIG. 25—the cover being secured about the jacket 136 by the Velcro hook-and-loop strips 254, 256.

While there has been described what is considered to be a preferred embodiment of the present invention, it will be readily appreciated by those skilled in the art that modifications can be made without departing from the scope of the teachings herein. For at least such reason, therefore, resort should be had to the claims appended hereto f or a complete understanding of the scope of the invention.

I claim:

1. A 1-step safety belt inflatable into a life vest comprising:

a rectangular, oblong or oval-shaped cell flotation device inflatable into a life vest capable of deflation and folding in a compact manner about the waist of a wearer;

a compressed gas cartridge coupled with said flotation device;

a gas cartridge actuator located on the outside of the belt to help assure proper inflation of the life vest, said actuator having a pin movable to puncture said cartridge to fill said flotation device with compressed gas;

means movable between said first and second positions, and connected to said pin for moving said pin to puncture said cartridge when moved to said second position;

wherein a portion of said flotation device about the waist of a wearer is temporarily secured in folded, overlapping relationship so as to unfold and expand outwardly under action of the compressed gas which fills it when said means is moved to said second position to puncture said cartridge, thereby increasing the length of said flotation device into a life vest;

wherein the sides of said life vest are held together by a neck strap at the top and two similar, overlapping straps at the bottom, said straps secured to each life vest side by box stitches;

a belt of a jacket with an adjustable waist strap underlying said flotation device with long Velcro strips that allow the jacket to be easily closed around the folded life vest, and then easily opened to help assure proper inflation of the life vest when the inflator activator lanyard is pulled; said jacket also serving both as an anchor system and as a protective cover for the folded life vest packed inside, and closable to fit about the waist of a wearer, and wherein said belt is closable by clasps fitting the waist of the wearer; and a drawstrap of adjustable length coupled between a point substantially centered along the length of said strap and between opposite ends of said life vest to secure said life vest to said belt when said life vest is inflated.

2. The safety belt of claim 1, further including a lock slide through which said drawstrap passes in connection between said folded life vest and said adjustable waist strap.

3. The safety belt of claim 2, additionally including a tab extension on an end of said drawstrap for releasably tightening said life vest and said adjustable strap.

4. The safety belt of claim 1, wherein said drawstrap is connected to said strap by a box-stitch secured at the inside center of said strap along its length.

5. The safety belt of claim 4, wherein said strap is closable about the waist to fit at the front of the wearer, and wherein said drawstrap is of a length to permit free rotation of said life vest vertically when inflated, while securing said inflated life vest to said strap.

6. The safety belt of claim 4, wherein said extension tab of said drawstrap is highlighted in color.

7. The safety belt of claim 6 wherein said gas cylinder actuator with pin-moving means has a lanyard and pull tab which is also highlighted in color.

8. The safety belt of claim 7, wherein said extension tab and said gas cylinder actuator pull tab are highlighted in different colors.

9. The safety belt of claim 1, wherein said jacket encloses said life vest in said belt in folded, overlapping relationship.

10. The safety belt of claim 9, also including releasable clasp and snap-buckle couplings at opposite ends of said waist strap to enclose said belt about the waist of a wearer.

11. The safety belt of claim 1, wherein said flotation device is easily foldable to a shape inside said jacket when deflated corresponding to a profile thereof.

* * * * *